US008350784B2

(12) United States Patent
Tomioka et al.

(10) Patent No.: US 8,350,784 B2
(45) Date of Patent: Jan. 8, 2013

(54) PLASMA DISPLAY DEVICE, AND METHOD FOR DRIVING PLASMA DISPLAY PANEL

(75) Inventors: Naoyuki Tomioka, Osaka (JP); Naoki Noguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 212 days.

(21) Appl. No.: 13/055,534

(22) PCT Filed: Aug. 4, 2009

(86) PCT No.: PCT/JP2009/003702

§ 371 (c)(1),
(2), (4) Date: Jan. 24, 2011

(87) PCT Pub. No.: WO2010/016233

PCT Pub. Date: Feb. 11, 2010

(65) Prior Publication Data

US 2011/0128308 A1 Jun. 2, 2011

(30) Foreign Application Priority Data

Aug. 7, 2008 (JP) ..... 2008-203974
Aug. 7, 2008 (JP) ..... 2008-203975

(51) Int. Cl.
*G09G 3/28* (2006.01)

(52) U.S. Cl. ..... 345/60; 345/66; 345/68; 345/690

(58) Field of Classification Search ..... 345/41, 345/60–63, 66–68, 76, 204, 690; 315/169.3, 315/169.4
See application file for complete search history.

(56) References Cited

U.S. PATENT DOCUMENTS 6,653,994 B2 11/2003 Takeda
6,844,685 B2 1/2005 Lee
7,525,512 B2 * 4/2009 Ikura et al. ..... 345/60
7,639,214 B2 12/2009 Jung
7,646,361 B2 1/2010 Jung
7,990,344 B2 * 8/2011 Maeda et al. ..... 345/63
(Continued)

FOREIGN PATENT DOCUMENTS

EP 1 852 844 A1 11/2007
(Continued)

OTHER PUBLICATIONS

Supplementary European Search Report for EP 09 80 4720, Sep. 20, 2011. International Search Report for PCT/JP2009/003702, Nov. 17, 2009.

*Primary Examiner* — Joe H Cheng
(74) *Attorney, Agent, or Firm* — RatnerPrestia

(57) ABSTRACT

In a plasma display panel, abnormal discharge in address periods is suppressed to enhance image display quality. The scan electrode driving circuit generates a first falling down-ramp voltage i.e. down-ramp voltage L2 or down-ramp voltage L4, in initializing periods, generates sustain pulses in sustain periods, generates a rising up-ramp voltage, i.e. erasing up-ramp voltage L3, at the ends of the sustain periods, and applies the voltages to the scan electrodes. After generating the sustain pulses in the sustain periods, the scan electrode driving circuit generates a second down-ramp voltage, i.e. erasing down-ramp voltage L5, which has a portion falling with a gradient gentler than that of down-ramp voltage L2 and down-ramp voltage L4. After generating erasing down-ramp voltage L5, the scan electrode driving circuit generates erasing up-ramp voltage L3 and applies the voltage to the scan electrodes.

7 Claims, 16 Drawing Sheets

U.S. PATENT DOCUMENTS

| | | | | |
|---|---|---|---|---|
| 8,068,069 | B2 * | 11/2011 | Origuchi et al. | 345/60 |
| 2002/0053882 | A1 | 5/2002 | Kanazawa et al. | |
| 2002/0075206 | A1 | 6/2002 | Takeda et al. | |
| 2004/0085262 | A1 | 5/2004 | Lee | |
| 2006/0109208 | A1 | 5/2006 | Jung | |
| 2006/0109209 | A1 | 5/2006 | Jung | |
| 2006/0109212 | A1 | 5/2006 | Yang et al. | |
| 2007/0008245 | A1 * | 1/2007 | Rhee et al. | 345/67 |
| 2007/0109224 | A1 * | 5/2007 | Choi et al. | 345/67 |
| 2007/0188410 | A1 * | 8/2007 | Choi et al. | 345/60 |
| 2008/0094316 | A1 * | 4/2008 | Takagi et al. | 345/63 |
| 2008/0117138 | A1 * | 5/2008 | Jang et al. | 345/63 |
| 2009/0085838 | A1 * | 4/2009 | Origuchi et al. | 345/60 |
| 2009/0122041 | A1 * | 5/2009 | Shoji et al. | 345/208 |
| 2009/0153535 | A1 | 6/2009 | Kaminaka et al. | |
| 2010/0277465 | A1 * | 11/2010 | Tomioka et al. | 345/213 |
| 2012/0050253 | A1 * | 3/2012 | Sakai et al. | 345/212 |

FOREIGN PATENT DOCUMENTS

| | | | |
|---|---|---|---|
| JP | 2000-242224 | A | 9/2000 |
| JP | 2001-052618 | A | 2/2001 |
| JP | 2001-210238 | A | 8/2001 |
| JP | 2002-072957 | A | 3/2002 |
| JP | 2002-149111 | A | 5/2002 |
| JP | 2003-263127 | A | 9/2003 |
| JP | 2004-037883 | A | 2/2004 |
| JP | 2004-062207 | A | 2/2004 |
| JP | 2006-146231 | A | 6/2006 |
| JP | 2006146229 | A | 6/2006 |
| JP | 2006146233 | A | 6/2006 |
| JP | 2006-349721 | A | 12/2006 |
| KR | 10-2008-0024656 | A | 3/2008 |
| WO | WO 2007/138680 | A1 | 12/2007 |

* cited by examiner

FIG. 13

| OC1 | OC2 | State of Scan IC |
|---|---|---|
| Hi | Hi | All-Hi |
| Hi | Lo | All-Lo |
| Lo | Hi | DATA |
| Lo | Lo | HiZ |

PLASMA DISPLAY DEVICE, AND METHOD FOR DRIVING PLASMA DISPLAY PANEL

This application is a U.S. NATIONAL PHASE APPLICATION OF PCT INTERNATIONAL APPLICATION No. PCT/JP2009/003702.

TECHNICAL FIELD

The present invention relates to a plasma display device for use in a wall-mounted television or a large monitor, and to a method for driving a plasma display panel.

BACKGROUND ART

A typical alternating-current surface discharge panel used as a plasma display panel (hereinafter simply referred to as "panel") has a large number of discharge cells that are formed between a front plate and a rear plate facing each other. The front plate has the following elements:

- a plurality of display electrode pairs, each formed of a scan electrode and a sustain electrode, disposed on a front glass substrate parallel to each other; and
- a dielectric layer and a protective layer formed so as to cover the display electrode pairs. The rear plate has the following elements:
- a plurality of parallel data electrodes formed on a rear glass substrate;
- a dielectric layer formed so as to cover the data electrodes;
- a plurality of barrier ribs formed on the dielectric layer parallel to the data electrodes; and
- phosphor layers formed on the surface of the dielectric layer and on the side faces of the barrier ribs.

The front plate and the rear plate face each other so that the display electrode pairs and the data electrodes three-dimensionally intersect, and are sealed together. A discharge gas containing xenon in a partial pressure ratio of 5%, for example, is charged into the sealed inside discharge space. Discharge cells are formed in portions where the display electrode pairs face the data electrodes. In a panel having such a structure, gas discharge generates ultraviolet light in each discharge cell. This ultraviolet light excites the red (R), green (G), and blue (B) phosphors so that the phosphors emit the corresponding colors for color display on the panel.

A subfield method is typically used as a method for driving the panel. In the subfield method, one field is divided into a plurality of subfields, and gradations are displayed by causing light emission or no light emission in each discharge cell in each subfield.

Each subfield has an initializing period, an address period, and a sustain period.

In the initializing period, an initializing waveform is applied to the respective scan electrodes to cause an initializing discharge in the respective discharge cells. This initializing discharge forms wall charge necessary for the subsequent address operation on the electrodes in the respective discharge cells. This discharge also generates priming particles (excitation particles for causing an address discharge) for stably causing the address discharge in the respective discharge cells.

In the address period, a scan pulse is applied to the scan electrodes, and an address pulse is selectively applied to the data electrodes according to the signals of an image to be displayed. Thereby, an address discharge is selectively caused to form wall charge in the discharge cells to be lit (hereinafter, this operation being also referred to as "addressing").

In the sustain period, sustain pulses corresponding in number to the luminance to be displayed are applied to display electrode pairs, each formed of a scan electrode and a sustain electrode. Thereby, a sustain discharge is caused in the discharge cells having undergone the address discharge, and thus the phosphor layers in the discharge cells are caused to emit light. In this manner, an image is displayed.

As one of the subfield methods, the following driving method is disclosed. In this driving method, an initializing discharge is caused with a gently-changing voltage waveform. Further, the initializing discharge is selectively caused in the discharge cells having undergone a sustain discharge. This operation minimizes the light emission unrelated to gradation display and improves the contrast ratio.

Specifically, in the initializing period of one subfield among a plurality of subfields, an all-cell initializing operation for causing an initializing discharge in all the discharge cells is performed. In the initializing periods of the other subfields, a selective initializing operation for causing an initializing discharge only in the discharge cells having undergone a sustain discharge in the immediately preceding sustain period is performed. With such driving, the luminance in an area displaying a black picture (hereinafter, simply referred to as "luminance of a black level") that is changed by light emission unrelated to image display is determined by a weak light emission in the all-cell initializing operation, and an image having a high contrast can be displayed (see Patent Literature 1, for example).

The following driving method is also disclosed. In this driving method, an initializing waveform that has the following two portions is applied in the initializing periods: a portion where the voltage rises with a gentle gradient; and a portion where the voltage falls with a gentle gradient. Immediately before this application, a weak discharge is caused between the sustain electrodes and scan electrodes in all the discharge cells. This operation can improve the visibility of black in the panel (see Patent Literature 2, for example).

With the recent increases in the definition of a panel, the discharge cells have been further miniaturized. The following phenomena are confirmed in such miniaturized discharge cells. The wall charge formed in such discharge cells by the initializing discharge is likely to be changed by the influence of the address discharge or sustain discharge caused in the adjacent discharge cells. The wall charge in the discharge cells undergoing no sustain discharge is likely to be changed by the influence of the adjacent discharge cells undergoing a sustain discharge, in the subfield where a large number of sustain pulses are generated in the sustain period. When unnecessary wall charge excessively accumulates in discharge cells, an erroneous address discharge (hereinafter, also referred to as "false discharge") can occur in the discharge cells where the address discharge is not to be caused. Such a false discharge deteriorates the image display quality.

CITATION LIST

Patent Literature

[PTL1] Japanese Patent Unexamined Publication No. 2000-242224

[PTL2] Japanese Patent Unexamined Publication No. 2004-37883

SUMMARY OF INVENTION

A plasma display device includes the following elements:

a panel, the panel being driven by a subfield method in which a plurality of subfields is set in one field for gradation display, and each of the subfields has an initializing period, an address period, and a sustain period, the panel having a plurality of scan electrodes; and a scan electrode driving circuit for generating a first falling down-ramp voltage in the initializing period, generating sustain pulses in the sustain period, generating a rising up-ramp voltage at the end of the sustain period, and applying the voltages to the scan electrodes. After generating the sustain pulses in the sustain period, the scan electrode driving circuit generates a second down-ramp voltage that has a portion falling with a gradient gentler than that of the first down-ramp voltage, and after generating the second down-ramp voltage, the scan electrode driving circuit generates the up-ramp voltage, and applies the voltages to the scan electrodes.

Even in a high-definition panel, this structure can properly adjust the wall charge for a stable address operation, suppress occurrence of an abnormal discharge in the address period, and thereby enhance the image display quality.

BRIEF DESCRIPTION OF DRAWINGS

FIG. 13 is a chart showing the correlation between control signal OC1 and control signal OC2 and an operation state of the scan ICs in accordance with the second exemplary embodiment.

DESCRIPTION OF EMBODIMENTS

Hereinafter, a plasma display device in accordance with exemplary embodiments of the present invention will be described, with reference to the accompanying drawings.

Example 1

Figure 1:
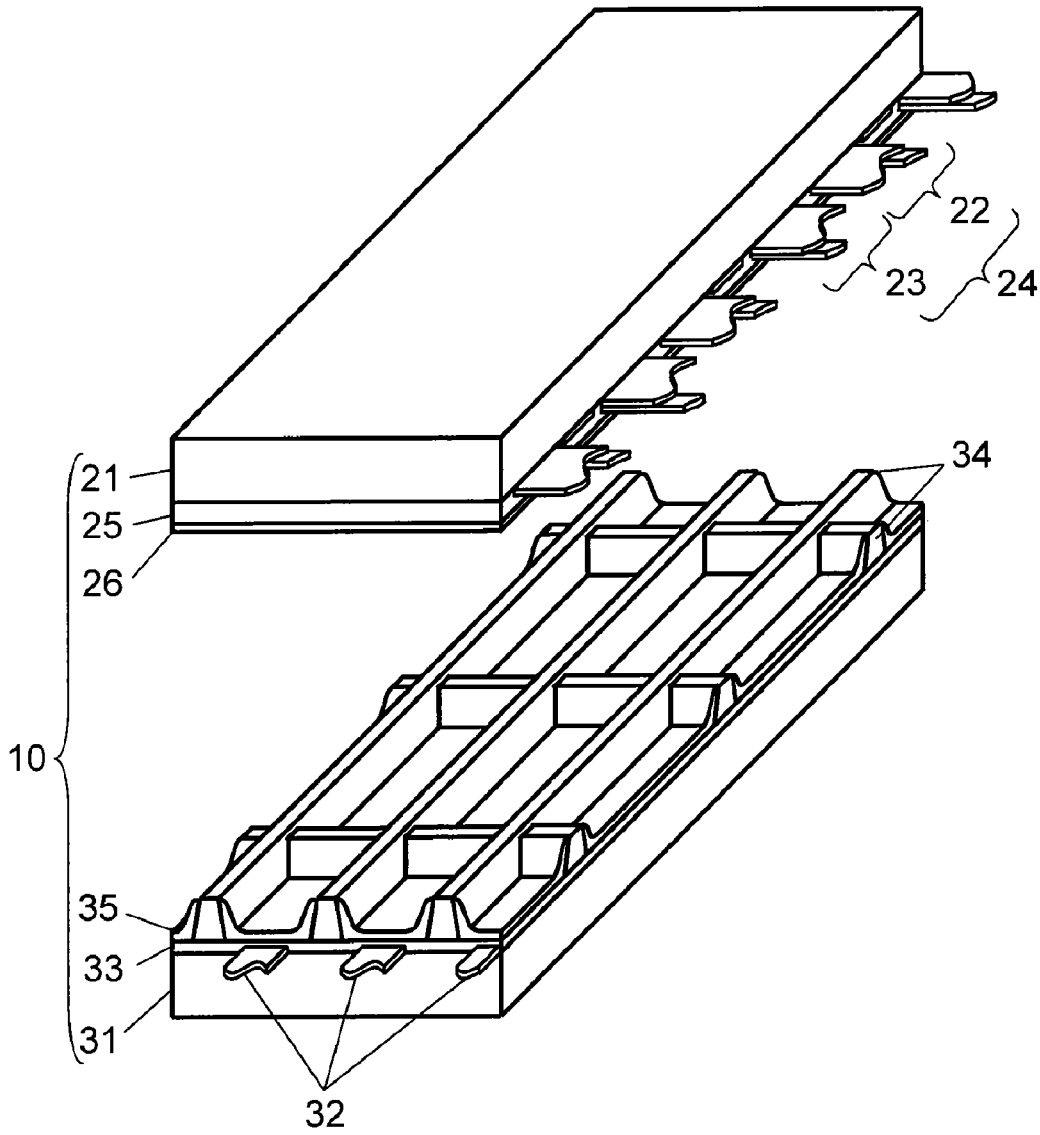
FIG. 1 is an exploded perspective view showing a structure of a panel in accordance with a first exemplary embodiment of the present invention.

FIG. 1 is an exploded perspective view showing a structure of panel 10 in accordance with the first exemplary embodiment of the present invention. A plurality of display electrode pairs 24, each formed of scan electrode 22 and sustain electrode 23, is disposed on glass front plate 21. Dielectric layer 25 is formed so as to cover scan electrodes 22 and sustain electrodes 23. Protective layer 26 is formed over dielectric layer 25.

In order to lower a breakdown voltage in discharge cells, protective layer 26 is made of a material predominantly composed of MgO because MgO has proven performance as a panel material, and exhibits a large secondary electron emission coefficient and excellent durability when neon (Ne) and xenon (Xe) gas is sealed.

A plurality of data electrodes 32 are formed on rear plate 31. Dielectric layer 33 is formed so as to cover data electrodes 32. Further, mesh barrier ribs 34 are formed on the dielectric layer. On the side faces of barrier ribs 34 and dielectric layer 33, phosphor layers 35 for emitting light of red (R), green (G), and blue (B) colors are formed.

Front plate 21 and rear plate 31 face each other so that display electrode pairs 24 intersect with data electrodes 32 with a small discharge space sandwiched between the electrodes. The outer peripheries of the plates are sealed with a sealing material, e.g. a glass frit. In the inside discharge space, a mixed gas of neon and xenon is charged as a discharge gas. In this exemplary embodiment, a discharge gas having a xenon partial pressure of approximately 10% is used to improve the emission efficiency. The discharge space is partitioned into a plurality of compartments by barrier ribs 34. Discharge cells are formed in intersecting parts of display electrode pairs 24 and data electrodes 32. These discharge cells discharge and emit light to display an image.

The structure of panel 10 is not limited to the above, and may include barrier ribs formed in a stripe pattern. The mixing ratio of the discharge gas is not limited to the above value, and other mixing ratios may be used.

Figure 2:
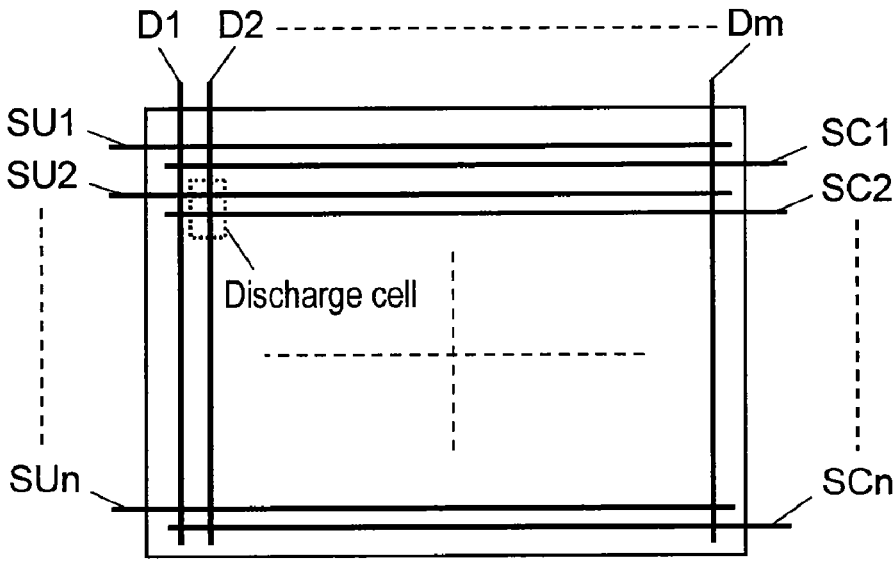
FIG. 2 is an electrode array diagram of the panel.

FIG. 2 is an electrode array diagram of panel 10 in accordance with the first exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both elongate in the row direction, and m data electrode D1 through data electrode Dm (data electrodes 32 in FIG. 1) elongate in the column direction. A discharge cell is formed in the part where a pair of scan electrode SCi (i being 1 through n) and sustain electrode SUi intersects with one data electrode Dj (j being 1 through m). Thus, m×n discharge cells are formed in the discharge space. The area where m×n discharge cells are formed is the display area of panel 10.

Figure 3:
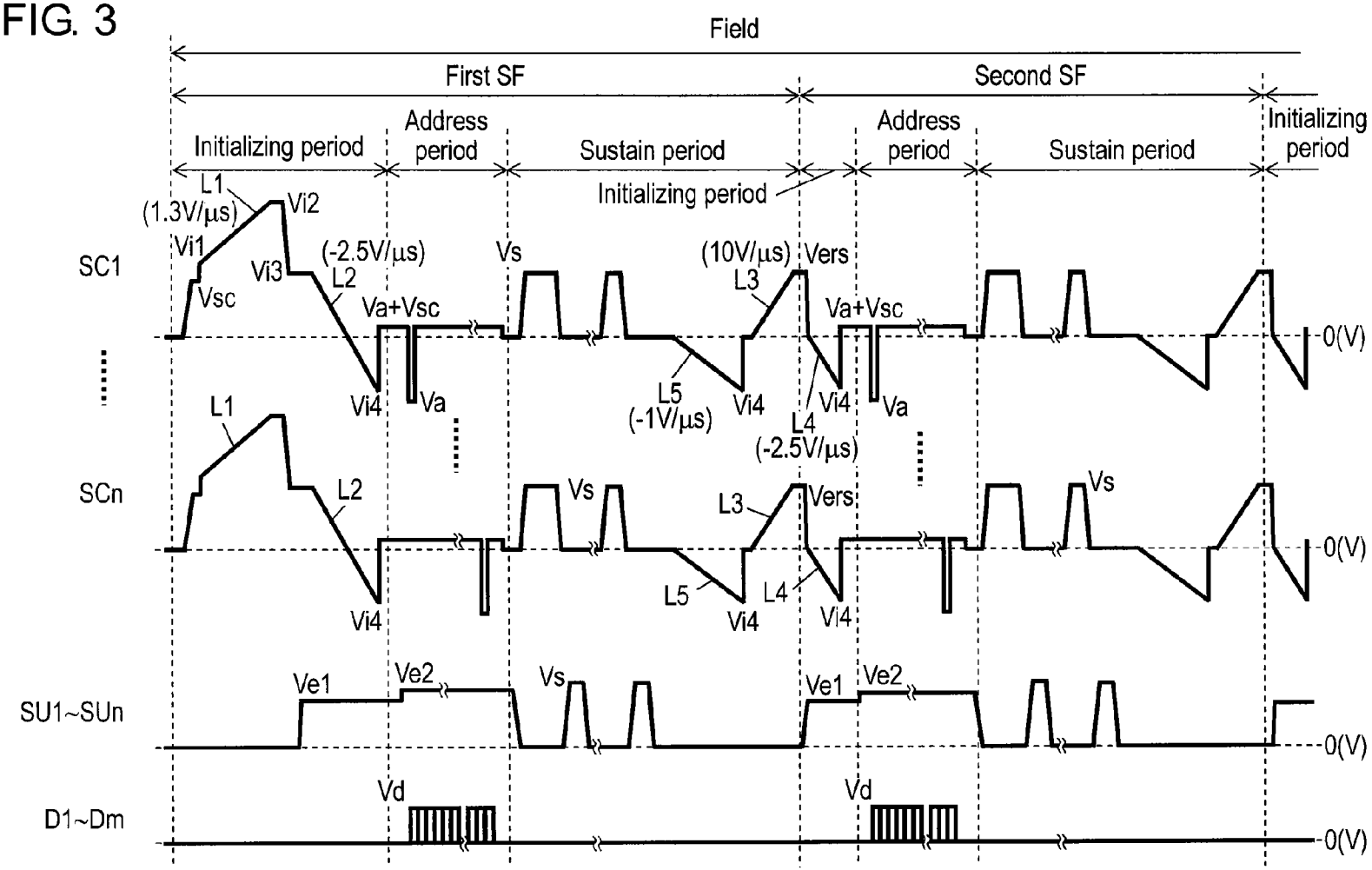
FIG. 3 is a waveform chart of driving voltages applied to the respective electrodes of the panel.

Next, driving voltage waveforms for driving panel 10 and the operation thereof are outlined, with reference to FIG. 3. A plasma display device of this exemplary embodiment drives panel 10 by a subfield method. This subfield method displays gradations in the following manner: one field is divided into a plurality of subfields along a temporal axis, a luminance weight is set for each subfield, and light emission and no light emission of each discharge cell is controlled in each subfield.

In this subfield (SF) method, one field is formed of eight subfields (the first SF, and the second SF through the eighth SF), and the respective subfields have luminance weights of 1, 2, 4, 8, 16, 32, 64, and 128, for example. In each subfield, sustain pulses equal in number to the luminance weight multiplied by a preset luminance magnification are generated. This operation controls the numbers of light emissions in the sustain periods and adjusts the brightness of the image. Further, in the initializing period of one subfield among the plurality of subfields, an all-cell initializing operation for causing an initializing discharge in all the discharge cells is performed (hereinafter, a subfield for the all-cell initializing operation being referred to as "all-cell initializing subfield"). In the initializing periods of the other subfields, a selective initializing operation for causing an initializing discharge selectively in the discharge cells having undergone a sustain discharge in the immediately preceding subfield is performed (hereinafter, a subfield for the selective initializing operation being referred to as "selective initializing subfield"). These operations can minimize the light emission unrelated to gradation display and improve the contrast ratio.

In this exemplary embodiment, in the initializing period of the first SF, the all-cell initializing operation is performed. In the initializing periods of the second SF through the eighth SF, the selective initializing operation is performed. With these operations, the light emission unrelated to image display is only the light emission caused by the discharge in the all-cell initializing operation in the first SF. Therefore, the luminance of a black level, i.e. the luminance of an area displaying a black picture where no sustain discharge is caused, is determined only by the weak light emission in the all-cell initializing operation. Thus, an image having a high contrast can be displayed. In the sustain period of each subfield, sustain pulses equal in number to the luminance weight of the subfield multiplied by a predetermined luminance magnification are applied to respective display electrode pairs 24.

However, in the present invention, the number of subfields, or the luminance weight of each subfield is not limited to the above values shown in this exemplary embodiment. The subfield structure may be switched according to image signals, for example.

In this exemplary embodiment, in each sustain period, a falling ramp voltage is generated and applied to the scan electrodes after generation of sustain pulses, and thereafter a rising ramp voltage is generated and applied to the scan electrodes. This application stabilizes the initializing operation in the initializing period and the address operation in the address period in the succeeding subfield. Hereinafter, first, driving voltage waveforms are outlined. Next, the configuration of a driving circuit is described.

FIG. 3 is a waveform chart of driving voltages applied to the respective electrodes of panel 10 in accordance with the first exemplary embodiment of the present invention.

FIG. 3 shows driving waveforms applied to scan electrode SC1 to be scanned first in the address periods, scan electrode SCn to be scanned last in the address periods (e.g. scan electrode SC1080), sustain electrode SU1 through sustain electrode SUn, and data electrode D1 through data electrode Dm.

FIG. 3 shows driving voltage waveforms in two subfields: the first subfield (first SF), i.e. an all-cell initializing subfield; and the second subfield (second SF), i.e. a selective initializing subfield. The driving voltage waveforms in the other subfields are substantially similar to driving voltage waveforms in the second SF, except for the numbers of sustain pulses generated in the sustain periods. In the following description, scan electrode SCi, sustain electrode SUi, and data electrode Dk show the electrodes selected from the corresponding electrodes, according to subfield data (data showing light emission and no light emission in each subfield).

First, a description is provided for the first SF, an all-cell initializing subfield.

In the first half of the initializing period of the first SF, 0(V) is applied to each of data electrode D1 through data electrode Dm and sustain electrode SU1 through sustain electrode SUn. To scan electrode SC1 through scan electrode SCn, 0 (V) and next voltage Vsc, and thereafter voltage Vi1 where a built-up voltage is superimposed on voltage Vsc are applied. Further, ramp voltage (hereinafter, referred to as "up-ramp voltage") L1, which rises gently (with a gradient of approximately 1.3 V/μsec, for example) from voltage Vi1 toward voltage Vi2, is applied. Here, voltage Vi1 is a voltage lower than a breakdown voltage, and voltage Vi2 is a voltage exceeding the breakdown voltage with respect to sustain electrode SU1 through sustain electrode SUn.

While up-ramp voltage L1 is rising, a weak initializing discharge continuously occurs between scan electrode SC1 through scan electrode SCn and sustain electrode SU1 through sustain electrode SUn, and between scan electrode SC1 through scan electrode SCn and data electrode D1 through data electrode Dm. Then, negative wall voltage accumulates on scan electrode SC1 through scan electrode SCn, and positive wall voltage accumulates on data electrode D1 through data electrode Dm and sustain electrode SU1 through sustain electrode SUn. Here, this wall voltage on the electrodes means the voltage generated by the wall charge that is accumulated on the dielectric layers covering the electrodes, the protective layer, the phosphor layers, or the like.

In the second half of the initializing period, positive voltage Ve1 is applied to sustain electrode SU1 through sustain electrode SUn, 0(V) is applied to data electrode D1 through data electrode Dm. To scan electrode SC1 through scan electrode SCn, ramp voltage (hereinafter referred to as "down-ramp voltage") L2, which falls gently (with a gradient of approximately −2.5 V/sec, for example) from voltage Vi3 toward negative voltage Vi4, is applied. Here, voltage Vi3 is a voltage lower than the breakdown voltage, and voltage Vi4 is a voltage exceeding the breakdown voltage with respect to sustain electrode SU1 through sustain electrode SUn.

In this application, a weak initializing discharge occurs between scan electrode SC1 through scan electrode SCn and sustain electrode SU1 through sustain electrode SUn, and between scan electrode SC1 through scan electrode SCn and data electrode D1 through data electrode Dm. This weak discharge reduces the negative wall voltage on scan electrode SC1 through scan electrode SCn, and the positive wall voltage on sustain electrode SU1 through sustain electrode SUn, and adjusts the positive wall voltage on data electrode D1 through data electrode Dm to a value appropriate for the address operation.

In this manner, the all-cell initializing operation for causing an initializing discharge in all the discharge cells is completed.

In the subsequent address period, a scan pulse voltage is sequentially applied to scan electrode SC1 through scan electrode SCn. Positive address pulse voltage Vd is applied to data electrode Dk (k being 1 through m) corresponding to a discharge cell to be lit among data electrode D1 through data electrode Dm. Thus, an address discharge is caused selectively in the corresponding discharge cells.

In this address period, first, voltage Ve2 is applied to sustain electrode SU1 through sustain electrode SUn, and (voltage Va+voltage Vsc) is applied to scan electrode SC1 through scan electrode SCn.

Next, negative scan pulse voltage Va is applied to scan electrode SC1 in the first row, and positive address pulse voltage Vd is applied to data electrode Dk (k being 1 through m) of the discharge cell to be lit in the first row among data electrode D1 through data electrode Dm.

At this time, the voltage difference in the intersecting part of data electrode Dk and scan electrode SC1 is obtained by adding the difference between the wall voltage on data electrode Dk and the wall voltage on scan electrode SC1 to the difference in an externally applied voltage (Vd−Va), and thus exceeds the breakdown voltage. Then, a discharge occurs between data electrodes Dk and scan electrode SC1. Since voltage Ve2 is applied to sustain electrode SU1 through sustain electrode SUn, the voltage difference between sustain electrode SU1 and scan electrode SC1 is obtained by adding the difference between the wall voltage on sustain electrode SU1 and the wall voltage on scan electrode SC1 to the difference in an externally applied voltage (Ve2−Va). At this time, setting voltage Vet to a value slightly lower than the breakdown voltage can make a state where a discharge is likely to occur but does not actually occur between sustain electrode SU1 and scan electrode SC1. With this setting, the discharge caused between data electrode Dk and scan electrode SC1 can trigger the discharge between the areas of sustain electrode SU1 and scan electrode SC1 intersecting with data electrode Dk. Thus, an address discharge occurs in the discharge cells to be lit. Positive wall voltage accumulates on scan electrode SC1 and negative wall voltage accumulates on sustain electrode SU1. Negative wall voltage also accumulates on data electrode Dk.

In this manner, the address operation is performed to cause the address discharge in the discharge cells to be lit in the first row and to accumulate wall voltages on the corresponding electrodes. On the other hand, the voltage in the intersecting parts of scan electrode SC1 and data electrode D1 through data electrode Dm applied with no address pulse voltage Vd does not exceed the breakdown voltage, and thus no address discharge occurs. The above address operation is sequentially performed until the operation reaches the discharge cells in the n-th row, and the address period is completed.

In the subsequent sustain period, sustain pulses equal in number to the luminance weight multiplied by a predetermined luminance magnification are alternately applied to display electrode pairs 24. Thereby, a sustain discharge is caused in the discharge cells having undergone the address discharge, for light emission of the discharge cells.

In this sustain period, first, positive sustain pulse voltage Vs is applied to scan electrode SC1 through scan electrode SCn, and a ground potential as a base potential, i.e. 0 (V), is applied to sustain electrode SU1 through sustain electrode SUn. Thus, the voltage to be applied to the discharge cells is obtained by adding the wall voltage on scan electrode SCi and the wall voltage on sustain electrode SUi to sustain pulse voltage Vs. Then, in the discharge cell having undergone an address discharge, the voltage difference between scan electrode SCi and sustain electrode SUi exceeds the breakdown voltage.

Then, in the discharge cell having undergone an address discharge, a sustain discharge occurs between scan electrode SCi and sustain electrode SUi, and the ultraviolet light generated at this time causes phosphor layers 35 to emit light. Thus, negative wall voltage accumulates on scan electrode SCi, and positive wall voltage accumulates on sustain electrodes SUi. Positive wall voltage also accumulates on data electrode Dk. In the discharge cells having undergone no address discharge in the address period, no sustain discharge occurs and the wall voltage at the completion of the initializing period is maintained.

Subsequently, 0 (V) as the base potential is applied to scan electrode SC1 through scan electrode SCn, and sustain pulse voltage Vs is applied to sustain electrode SU1 to sustain electrode SUn. In the discharge cell having undergone the sustain discharge, the voltage difference between sustain electrode SUi and scan electrode SCi exceeds the breakdown voltage. Thereby, a sustain discharge occurs between sustain electrode SUi and scan electrode SCi again. Then, negative wall voltage accumulates on sustain electrode SUi, and positive wall voltage accumulates on scan electrode SCi. Similarly, sustain pulses equal in number to the luminance weight multiplied by the luminance magnification are alternately applied to scan electrode SC1 through scan electrode SCn and sustain electrode SU1 through sustain electrode SUn to cause a potential difference between the electrodes of display electrode pairs 24. Thereby, the sustain discharge is continued in the discharge cells having undergone the address discharge in the address period.

After the last sustain pulse in the sustain period is applied to sustain electrode SC1 through sustain electrode SUn, second down-ramp voltage (hereinafter, referred to as "erasing down-ramp voltage") L5 is applied to scan electrode SC1 through scan electrode SCn, while 0 (V) is applied to sustain electrode SU1 through sustain electrode SUn and data electrode D1 through data electrode Dm. Here, erasing down-ramp voltage L5 gently falls from the ground potential, i.e. 0 (V), equal to or lower than the breakdown voltage toward negative voltage Vi4 exceeding the breakdown voltage with respect to data electrode D1 through data electrode Dm. At this time, in this exemplary embodiment, erasing down-ramp voltage L5 has a gradient (e.g. −1 V/μsec) gentler than that of down-ramp voltage L2 and down-ramp voltage L4 to be described later generated in the initializing periods.

While this erasing down-ramp voltage L5 is applied to scan electrode SC1 through scan electrode SCn, a weak erasing discharge occurs between scan electrodes 22 and data electrodes 32 in the discharge cells where unnecessary negative wall charge is accumulated on scan electrodes 22 among the unlit discharge cells having undergone no address discharge and no sustain discharge. This weak discharge continuously occurs in a period during which the voltage applied to scan electrode SC1 through scan electrode SCn falls. When the falling voltage reaches Vi4 as a predetermined voltage, the voltage applied to scan electrode SC1 through scan electrode SCn is raised to 0 (V).

At this time, charged particles (priming particles) generated in this weak erasing discharge accumulate on scan electrodes 22 and data electrodes 32 so as to reduce the voltage difference between scan electrodes 22 and data electrodes 32.

Thus, the unnecessary negative wall charge accumulated in the discharge cells is erased. That is, the discharge caused by erasing down-ramp voltage L5 works as an erasing discharge for erasing the unnecessary negative wall charge.

The reason why the unnecessary negative wall charge accumulates on scan electrodes 22 in unlit discharge cells is considered as follows. In the unlit discharge cells having undergone no address discharge and no sustain discharge after the initializing discharge, no discharge occurs until an address discharge occurs next. However, even in the unlit discharge cells undergoing no sustain discharge, sustain pulses are applied to display electrode pairs 24. For this reason, when a sustain discharge occurs in a discharge cell adjacent to an unlit discharge cell, a part of the charged particles (priming particles) generated by the sustain discharge is transferred to the unlit discharge cell by the sustain pulse voltage applied to display electrode pairs 24. Especially, the part of the charged particles are attracted onto scan electrodes 22 by the sustain pulse voltage applied to scan electrodes 22. Then, the transferred priming particles accumulate as unnecessary negative wall charge on scan electrodes 22 in the unlit discharge cells. In this manner, unnecessary negative wall charge accumulates on scan electrodes 22 in unlit discharge cells.

Further, this transfer of priming particles and resulting accumulation of unnecessary negative wall charge are likely to occur in the discharge cells miniaturized with the increases in the definition of the panel. The amount of unnecessary negative wall charge accumulating in the discharge cells increases with an increase in the period during which one of two adjacent discharge cells undergoes a sustain discharge and the other of the discharge cells undergoes no sustain discharge. That is, the accumulation of unnecessary negative wall charge is more likely to occur in a subfield where the luminance weight and the number of sustain pulses are large.

Further, when such unnecessary negative wall charge accumulates excessively, an abnormal discharge can occur in application of down-ramp voltage L4 to be described later to scan electrode SC1 through scan electrode SCn in the initializing periods. This abnormal discharge makes the state of the wall voltage different from that in a normal initializing discharge, and further generates unnecessary priming particles. This phenomenon can cause an erroneous address discharge in a subfield where no address discharge is to be caused, and deteriorate the image display quality.

However, in this exemplary embodiment, in the discharge cells where unnecessary negative wall voltage is accumulated on scan electrodes 22 among the unlit discharge cells having undergone no address discharge and no sustain discharge, erasing down-ramp voltage L5 can cause a weak discharge between scan electrodes 22 and data electrodes 32 to erase the unnecessary negative wall charge accumulated in the discharge cells. This operation can erase the unnecessary wall charge, i.e. a cause of a false discharge, and thus prevent the occurrence of a false discharge in a subfield where no address discharge is to be caused. Thereby, the deterioration of the image display quality can be prevented.

As described above, in the sustain discharge caused by application of sustain pulses to sustain electrodes 23, negative wall charge accumulates on sustain electrode SUi and positive wall charge accumulates on scan electrode SCi. Therefore, in the structure of this exemplary embodiment where the last sustain pulse in each sustain period is applied to sustain electrode SU1 through sustain electrode SUn, negative wall charge accumulates on sustain electrode SUi and positive wall charge accumulates on scan electrode SCi in the discharge cells having undergone an address discharge, after the last sustain pulse is generated. Thus, in this exemplary embodiment, in the discharge cells having undergone an address discharge and a sustain discharge, even application of erasing down-ramp voltage L5, which falls from 0 (V) toward negative voltage Vi4, does not cause the above erasing discharge.

In the discharge cells where unnecessary negative wall charge is not accumulated on scan electrodes 22 even among the unlit cells having undergone no address discharge and no sustain discharge, the normal state of the wall charge at the completion of the previous initializing discharge is substantially maintained. For this reason, when erasing down-ramp voltage L5 with voltage Vi4 optimally set is applied to scan electrode SC1 through scan electrode SCn, the potential difference between scan electrodes 22 and data electrodes 32 does not exceed the breakdown voltage. Thus, the above erasing discharge does not occur. In the discharge cells where the unnecessary negative wall voltage is accumulated on scan electrodes 22 but the amount is too small to cause a false discharge, similarly, erasing down-ramp voltage L5 does not cause the erasing discharge.

That is, in the structure of this exemplary embodiment, erasing down-ramp voltage L5, which falls from 0 (V) toward negative voltage Vi4, is generated and applied to scan electrode SC1 through scan electrode SCn. With this structure, only in the discharge cells where unnecessary negative wall charge is accumulated on scan electrodes 22 among the unlit discharge cells having undergone no address discharge and no sustain discharge, erasing down-ramp voltage L5 can cause the erasing discharge.

It is verified that, in down-ramp voltage L2 and down-ramp voltage L4 to be described later, a gentle gradient can reduce the occurrence of the above abnormal discharge, but an excessively gentle gradient reduces the original advantage of adjusting the wall voltage. Then, in this exemplary embodiment, down ramp voltage L2 and down ramp voltage L4 to be described later are both generated with a gradient of −2.5 V/μsec, for example.

It is also verified that, in erasing down-ramp voltage L5, the gentler gradient increases the advantages of removing the unnecessary wall charge, i.e. a cause of a false discharge, and reducing the occurrence of the above abnormal discharge. Then, in this exemplary embodiment, erasing down-ramp voltage L5 is generated with a gradient gentler than −2.5 V/μsec. However, it is also verified that the above advantage is saturated as the gradient of erasing down-ramp voltage L5 becomes gentler. Further, as the gradient of erasing down-ramp voltage L5 becomes gentler, the time taken for generating erasing down-ramp voltage L5 increases. For these reasons, practically, it is preferable to set the gradient of erasing down-ramp voltage L5 equal to or steeper than −0.5 V/μsec.

According to the above, in this exemplary embodiment, the gradient of erasing down-ramp voltage L5 is set to a gradient gentler than that of down-ramp voltage L2 and down-ramp voltage L4 to be described later, in the range equal to or steeper than −0.5 V/μsec and gentler than −2.5 V/μsec. For example, in this exemplary embodiment, the gradient of erasing down-ramp voltage L5 is set to −1 V/μsec.

At the end of the sustain period, i.e. after the application of erasing down-ramp voltage L5 to scan electrode SC1 through scan electrode SCn, ramp voltage (hereinafter, referred to as "erasing up-ramp voltage") L3, which gently rises from 0 (V) toward voltage Vers, is applied to scan electrode SC1 through scan electrode SCn. At this time, voltage Vers is a voltage exceeding the breakdown voltage. Thereby, in the discharge cell having undergone the sustain discharge, a weak discharge is continuously caused, and a part or the whole of the wall voltages on scan electrode SCi and sustain electrode SUi is erased while the positive wall voltage is left on data electrode Dk.

Specifically, erasing up-ramp voltage L3, which rises from 0 (V) toward voltage Vers exceeding the breakdown voltage, is generated with a gradient (e.g. approximately 10 V/μsec) steeper than that of up-ramp voltage L1, and applied to scan electrode SC1 through scan electrode SCn. Then, a weak discharge occurs between sustain electrode SUi and scan electrode SCi in the discharge cell having undergone the sustain discharge. This weak discharge continuously occurs while the voltage applied to scan electrode SC1 through scan electrode SCn is rising. After the rising voltage has reached voltage Vers as a predetermined voltage, the voltage applied to scan electrode SC1 through scan electrode SCn is dropped to 0 (V) as the base potential.

At this time, the charged particles generated by this weak discharge accumulate on sustain electrode SUi and scan electrode SCi as wall charge so as to reduce the voltage difference between sustain electrode SUi and scan electrode SCi. Thereby, the wall voltage between scan electrode SC1 through scan electrode SCn and sustain electrode SU1 through sustain electrode SUn is reduced to the difference between the voltage applied to scan electrode SCi and the breakdown voltage, e.g. a level of (voltage Vers−breakdown voltage). That is, the discharge caused by erasing up-ramp voltage L3 works as an erasing discharge.

Thereafter, the voltage applied to scan electrode SC1 through scan electrode SCn is returned to 0 (V). Thus, the sustain operation in the sustain period is completed.

In the initializing period of the second SF, the driving voltage waveforms where those in the first half of the initializing period of the first SF are omitted are applied to the respective electrodes. That is, voltage Ve1 is applied to sustain electrode SU1 through sustain electrode SUn, and 0 (V) is applied to data electrode D1 through data electrode Dm. Down-ramp voltage L4, i.e. a first down-ramp voltage, is applied to scan electrode SC1 through scan electrode SCn. Here, down-ramp voltage L4 falls from a voltage lower than the breakdown voltage (e.g. 0 (V)) toward negative voltage Vi4 exceeding the breakdown voltage, with a gradient equal to that of down-ramp voltage L2 (e.g. approximately −2.5 V/μsec). In this exemplary embodiment, down-ramp voltage L2 and down-ramp voltage L4 have an equal gradient and an equal minimum voltage. Thus, down-ramp voltage L2 is also included in the first down-ramp voltage.

Thus, a weak initializing discharge occurs in the discharge cells having undergone a sustain discharge in the sustain period of the immediately preceding subfield (the first SF in FIG. 3). This discharge reduces the wall voltage on scan electrode SCi and sustain electrode SUi, and adjusts the wall voltage on data electrode Dk (k being 1 through m) to a value appropriate for the address operation. On the other hand, in the discharge cells having undergone no sustain discharge in the preceding subfield, no initializing discharge occurs.

In this manner, the initializing operation in the second SF is a selective initializing operation for causing an initializing discharge in the discharge cells having undergone a sustain operation in the sustain period of the immediately preceding subfield.

In this exemplary embodiment, as described above, the erasing discharge caused by erasing down-ramp voltage L5 can remove the unnecessary negative wall charge, i.e. a cause of a false discharge, in the unlit discharge cells. Therefore, this operation can prevent the occurrence of the above abnormal discharge in application of down-ramp voltage L4 to scan electrode SC1 through scan electrode SCn, and reduce the occurrence of a false address discharge in a subfield where an address discharge is not to be caused.

In the address period of the second SF, the driving waveforms similar to those in the address period of the first SF are applied to scan electrode SC1 through scan electrode SCn, sustain electrode SU1 through sustain electrode SUn, and data electrode D1 through data electrode Dm.

In the sustain period of the second SF, similar to the sustain period of the first SF, a predetermined number of sustain pulses are alternately applied to scan electrode SC1 through scan electrode SCn and sustain electrode SU1 through sustain electrode SUn. Thereby, a sustain discharge is caused in the discharge cells having undergone an address discharge in the address period. Then, after application of the sustain pulses, similarly to the sustain period of the first SF, erasing down-ramp voltage L5 is applied to scan electrode SC1 through scan electrode SCn. Thereby, an erasing discharge is caused in the discharge cells where unnecessary negative wall charge is accumulated on scan electrodes 22 among the unlit cells having undergone no sustain discharge.

Thereafter, erasing up-ramp voltage L3 is applied to scan electrode SC1 through scan electrode SCn to cause an erasing discharge in the discharge cells having undergone the sustain discharge.

In the third SF and the subfields thereafter, the driving waveforms similar to those in the second SF except for the numbers of sustain pulses generated in the sustain periods are applied to scan electrode SC1 through scan electrode SCn, sustain electrode SU1 through sustain electrode SUn, and data electrode D1 through data electrode Dm.

The above description has outlined the driving voltage waveforms applied to the respective electrodes of panel 10.

Figure 4:
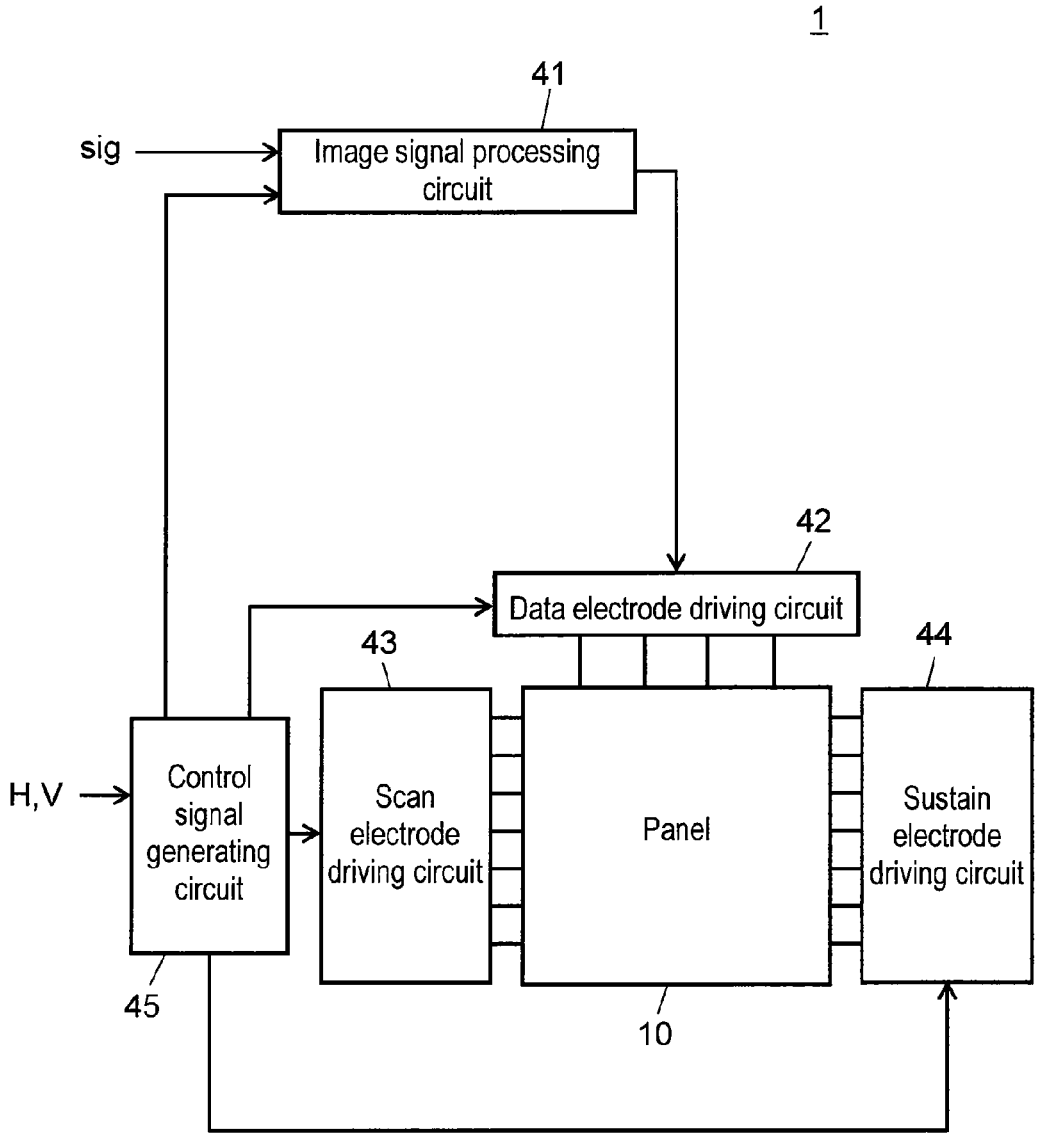
FIG. 4 is a circuit block diagram of a plasma display device in accordance with the first exemplary embodiment.

Next, a description is provided for a structure of a plasma display device in accordance with this exemplary embodiment. FIG. 4 is a circuit block diagram of plasma display device 1 in accordance with the first exemplary embodiment of the present invention. Plasma display device 1 has the following elements:

- panel 10;
- image signal processing circuit 41;
- data electrode driving circuit 42;
- scan electrode driving circuit 43;
- sustain electrode driving circuit 44;
- control signal generating circuit 45; and
- power supply circuits (not shown) for supplying power necessary for the respective circuit blocks.

In order to cause the discharge cells to emit light with a brightness corresponding to the gradation value of image signal sig, image signal processing circuit 41 converts input image signal sig into subfield data showing light emission and no light emission in each subfield, according to the number of discharge cells in panel 10.

Control signal generating circuit 45 generates various control signals for controlling the operation of the respective circuit blocks according to horizontal synchronizing signal H and vertical synchronizing signal V, and supplies the control signals to the respective circuit blocks (i.e. image signal processing circuit 41, data electrode driving circuit 42, scan electrode driving circuit 43, and sustain electrode driving circuit 44).

Data electrode driving circuit 42 converts subfield data in each subfield into signals corresponding to each of data electrode D1 through data electrode Dm, and drives each of data electrode D1 through data electrode Dm according to the control signals supplied from control signal generating circuit 45.

Scan electrode driving circuit 43 has an initializing waveform generating circuit, a sustain pulse generating circuit, and a scan pulse generating circuit. The initializing waveform generating circuit generates initializing waveforms to be applied to scan electrode SC1 through scan electrode SCn in the initializing periods. The sustain pulse generating circuit generates sustain pulses to be applied to scan electrode SC1 through scan electrode SCn in the sustain periods. The scan pulse generating circuit has a plurality of integrated circuits for driving scan electrodes (hereinafter, simply referred to as "scan ICs"), and generates a scan pulse to be applied to scan electrode SC1 through scan electrode SCn in the address periods. Scan electrode driving circuit 43 drives each of scan electrode SC1 through scan electrode SCn, in response to the control signals supplied from control signal generating circuit 45.

Sustain electrode driving circuit 44 has a sustain pulse generating circuit, and a circuit for generating voltage Ve1 and voltage Ve2 (not shown), and drives sustain electrode SU1 through sustain electrode SUn in response to the control signals supplied from control signal generating circuit 45.

Next, the details and operation of scan electrode driving circuit 43 are described.

Figure 5:
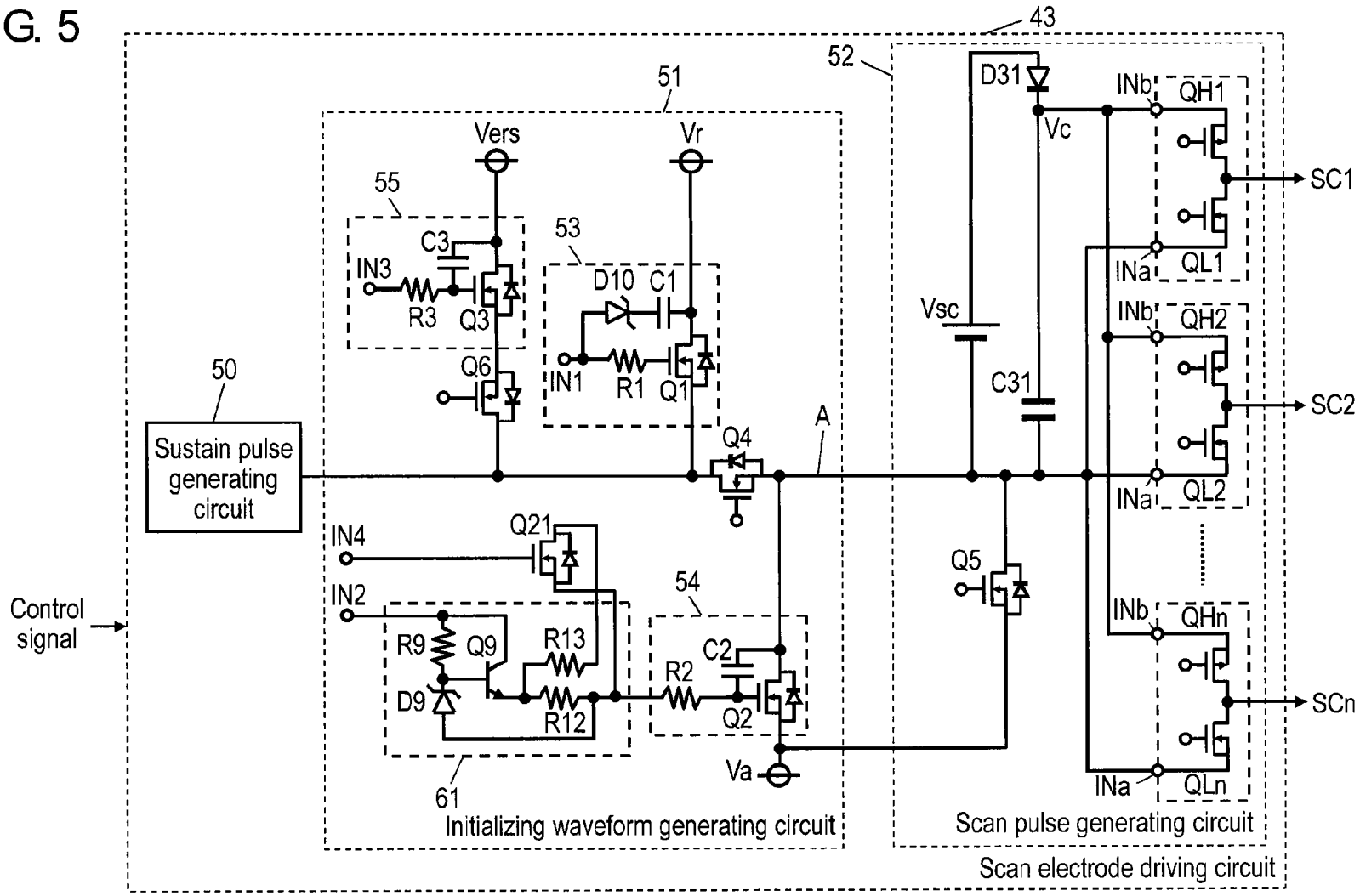
FIG. 5 is a circuit diagram showing a configuration example of a scan electrode driving circuit of the plasma display device.

FIG. 5 is a circuit diagram showing a configuration example of scan electrode driving circuit 43 of plasma display device 1 in accordance with the first exemplary embodiment of the present invention.

Scan electrode driving circuit 43 has the following elements:

- sustain pulse generating circuit 50 for generating sustain pulses;
- initializing waveform generating circuit 51 for generating initializing waveforms; and
- scan pulse generating circuit 52 for generating scan pulses.

Each output terminal of scan pulse generating circuit 52 is connected to corresponding one of scan electrode SC1 through scan electrode SCn of panel 10. In this exemplary embodiment, the voltage input to scan pulse generating circuit 52 is denoted as "reference potential A". In the following description, the operation of bringing a switching element into conduction is denoted as "ON", and the operation of bringing a switching element out of conduction is denoted as "OFF". A signal for setting a switching element to ON is denoted as "Hi", and a signal for setting a switching element to OFF is denoted as "Lo".

FIG. 5 shows a separating circuit using switching element Q4, for electrically separating sustain pulse generating circuit 50, a circuit based on voltage Vr (e.g. Miller integrating circuit 53), and a circuit based on voltage Vers (e.g. Miller integrating circuit 55) from a circuit based on negative voltage Va (e.g. Miller integrating circuit 54) while the latter circuit is operated. The diagram also shows a separating circuit using switching element Q6, for electrically separating a circuit based on voltage Vers (e.g. Miller integrating circuit 55), which is lower than voltage Vr, from a circuit based on voltage Vr (e.g. Miller integrating circuit 53) while the latter circuit is operated.

Sustain pulse generating circuit 50 has a generally-used power recovery circuit (not shown) and clamp circuit (not shown), and generates sustain pulses by switching the respective switching elements included in sustain pulse generating circuit 50, in response to the control signals output from control signal generating circuit 45. In FIG. 5, the details of the paths of the control signals are omitted.

Scan pulse generating circuit 52 has switching element QH1 through switching element QHn and switching element QL1 through switching element QLn for applying a scan pulse voltage to n scan electrode SC1 through scan electrode SCn, respectively. Switching element QH1 through switching element QHn and switching element QL1 through switching element QLn are grouped in a plurality of outputs and formed into ICs. These ICs are scan ICs.

Scan pulse generating circuit 52 has the following elements:

- switching element Q5 for connecting reference potential A to negative voltage Va in the address periods;
- power supply VSC for generating voltage Vsc, and superimposing voltage Vsc on reference potential A; and
- diode D31 and capacitor C31 for applying voltage Vc where voltage Vscn is superimposed on reference potential A, to input terminals INb. Voltage Vc is input to input terminal INb of each of switching element QH1 through switching element QHn; reference potential A is input to input terminal INa of each of switching element QL1 through switching element QLn.

In scan pulse generating circuit 52 configured as above, switching element Q5 is set to ON so that reference potential A becomes equal to negative voltage Va in the address periods. Negative voltage Va is input to input terminal INa; voltage Vc, i.e. negative voltage Va+voltage Vsc, is input to input terminal INb. Then, to scan electrode SCi to be applied with a scan pulse according to subfield data, negative scan pulse Va is applied via switching element QLi, by setting switching element QHi to OFF and switching element QLi to ON. On the other hand, to scan electrode SCh to be applied with no scan pulse (h being 1 through n except i), voltage Va+voltage Vsc is applied via switching element QHh, by setting switching element QLn to OFF and switching element QHh to ON.

Scan pulse generating circuit 52 is controlled by control signal generating circuit 45 so as to output the voltage waveforms in initializing waveform generating circuit 51 in the initializing periods and output the voltage waveforms in sustain pulse generating circuit 50 in the sustain periods.

Initializing waveform generating circuit 51 has Miller integrating circuit 53, Miller integrating circuit 54, Miller integrating circuit 55, and constant current generating circuit 61. Each of Miller integrating circuit 53 and Miller integrating circuit 55 is a ramp voltage generating circuit for generating a rising ramp voltage. Miller integrating circuit 54 is a ramp voltage generating circuit for generating a falling ramp voltage. In FIG. 5, the input terminal of Miller integrating circuit 53 is shown as input terminal IN1, the input terminal of Miller integrating circuit 55 as input terminal IN3, and the input terminal of constant current generating circuit 61 as input terminal IN2.

Miller integrating circuit 53 has switching element Q1, capacitor C1, resistor R1, and Zener diode D10 series-connected to capacitor C1. In the initializing operation, this Miller integrating circuit 53 generates up-ramp voltage L1, by causing reference potential A of scan electrode driving circuit 43 to rise to voltage Vi2 with a gentle gradient (e.g. 1.3 V/μsec) in a ramp form. Zener diode D10 generates voltage Vi1 by superimposing a Zener voltage (e.g. 45 (V)) as a built-up voltage on voltage Vsc, in the all-cell initializing operation (in the initializing period of the first SF, herein). That is, Zener diode D10 works to set the start-up voltage of up-ramp voltage L1 (the voltage at which the ramp voltage starts to rise) to voltage Vi1.

Miller integrating circuit 55 has switching element Q3, capacitor C3, and resistor R3. At the end of each sustain period, i.e. after generation of erasing down-ramp voltage L5, this Miller integrating circuit 55 generates erasing up-ramp voltage L3, by causing reference potential A to rise to voltage Vers with a gradient (e.g. 10 V/μsec) steeper than that of up-ramp voltage L1.

Miller integrating circuit 54 has switching element Q2, capacitor C2, and resistor R2. In the initializing operation, this Miller integrating circuit 54 generates down-ramp voltage L2 and down-ramp voltage L4, by causing reference potential A to fall to voltage Vi4 with a gentle gradient (e.g. −2.5 V/μsec) in a ramp form. After generation of the sustain pulses in sustain periods, this Miller integrating circuit 54 generates erasing down-ramp voltage L5, by causing reference potential A to fall to voltage Vi4 with a gradient (e.g. −1 V/μsec) gentler than that of down-ramp voltage L2 and down-ramp voltage L4.

Constant current generating circuit 61 has transistor Q9, resistor R9, Zener diode D9, and resistor R12. The collector of transistor Q9 is connected to input terminal IN2. Resistor R9 is interposed between input terminal IN2 and the base of transistor Q9. The cathode of Zener diode D9 is connected to resistor R9; the anode thereof is connected to resistor R2. Resistor R12 is series-connected between the emitter of transistor Q9 and resistor R2. Constant current generating circuit 61 generates a constant current when a predetermined voltage (e.g. 5 (V)) is input to input terminal IN2. This constant current is input to Miller integrating circuit 54. While this constant current is input, Miller integrating circuit 54 causes the potential of reference potential A to fall in a ramp form.

Initializing waveform generating circuit 51 of this exemplary embodiment has switching element Q21. The gate of switching element Q21 is input terminal IN4. Switching element Q21 is set to ON when the control signal applied to input terminal IN4 is at "Hi" (e.g. 5 (V)), and set to OFF when the control signal is at "Lo" (e.g. 0 (V)). Constant current generating circuit 61 has resistor R13. Resistor R13 allows the value of the constant current output from constant current generating circuit 61 to change, according to the switching operation of switching element Q21. Specifically, one terminal of resistor R13 is connected to the junction point between resistor R12 and transistor Q9, and the other terminal is connected to the drain of switching element Q21. The source of switching element Q21 is connected to the junction point between resistor R12 and resistor R2. With this configuration, when switching element Q21 is set to ON, resistor R12 and resistor R13 are electrically connected in parallel with each other. This operation makes the value of the constant current output from constant current generating circuit 61 higher than that when switching element Q21 is set to OFF. Thus, the gradient of the ramp voltage output from Miller integrating circuit 54 can be increased.

With this configuration, Miller integrating circuit 54 can generate two types of ramp voltage having different gradients, i.e. down-ramp voltage L2 and down-ramp voltage L4 in the initializing operation, and erasing down-ramp voltage L5 after sustain pulses in the sustain periods.

Figure 6:
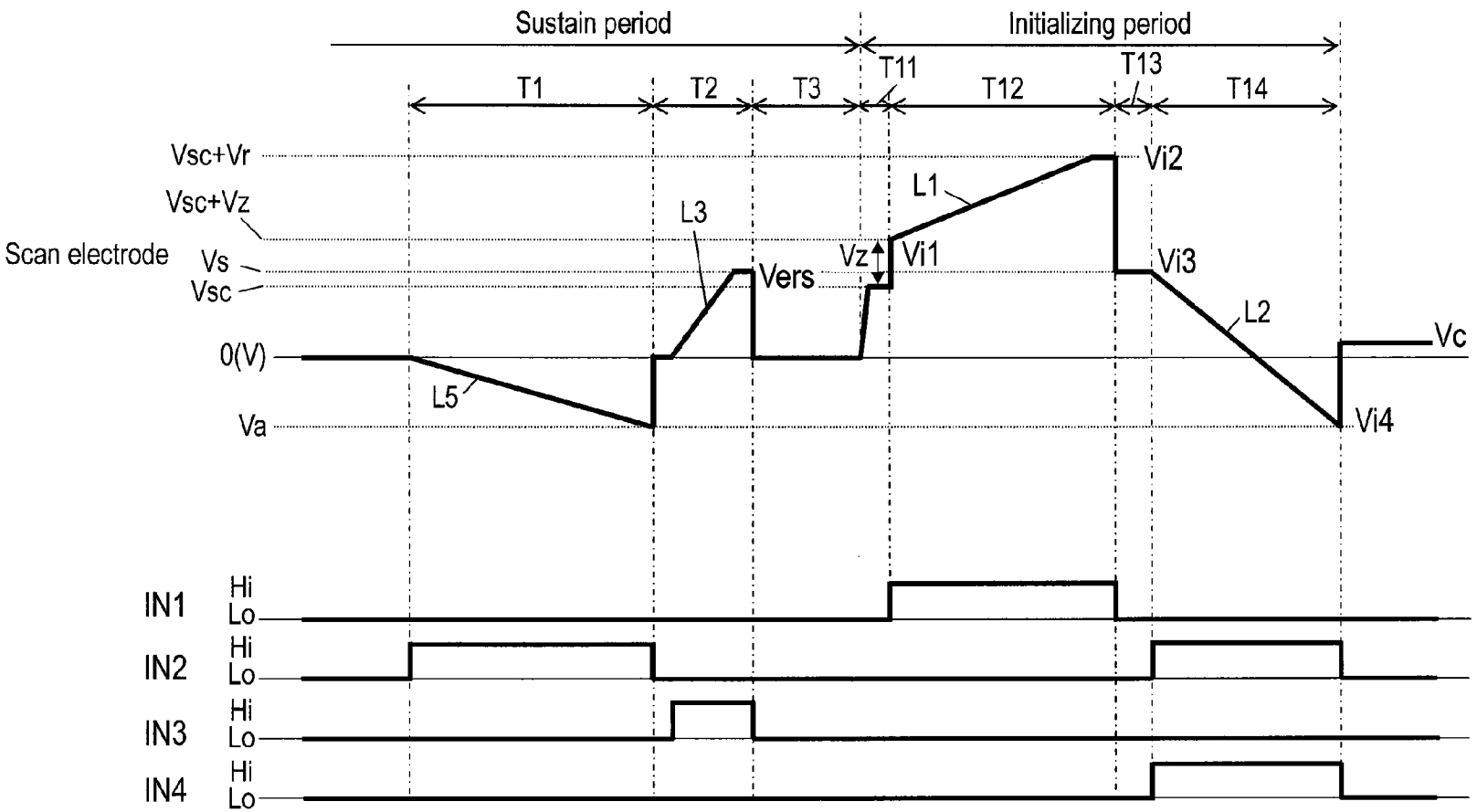
FIG. 6 is timing chart for explaining an example of the operation of the scan electrode driving circuit in an all-cell initializing period in accordance with the first exemplary embodiment.

Next, a description is provided for the operation of generating down-ramp voltage L2, i.e. the first down-ramp voltage, and erasing down-ramp voltage L5, i.e. the second down-ramp voltage falling with a gradient gentler than that of down-ramp voltage L2 and down-ramp voltage L4, with reference to FIG. 6.

FIG. 6 is a timing chart for explaining an example of the operation of scan electrode driving circuit 43 in an all-cell initializing period in accordance with the first exemplary embodiment of the present invention. In this chart, a driving waveform in the all-cell initializing operation is described as an example. The operation of generating down-ramp voltage L4 in a selective initializing operation is similar to the operation of generating down-ramp voltage L2 described with reference to FIG. 6.

In FIG. 6, the driving waveform at the end of the sustain period is divided into three sub-periods shown by sub-period T1 through sub-period T3, and the driving waveform for the all-cell initializing operation is divided into four sub-periods shown by sub-period T11 through sub-period T14. Each sub-period is described. In the description, voltage Vi3 is equal to voltage Vs, voltage Vi2 is equal to voltage Vsc+voltage Vr, and voltage Vi4 is equal to negative voltage Va. In this chart, a signal for setting a switching element to ON is denoted as "Hi", and a signal for setting a switching element to OFF as "Lo".

Hereinafter, a description is provided for the operation of generating erasing down-ramp voltage L5 after generating the sustain pulses in the sustain period, and thereafter generating erasing up-ramp voltage L3.

First, before sub-period T1, the clamp circuit of sustain pulse generating circuit 50 is operated to set reference potential A to 0 (V). Next, switching element QH1 through switching element QHn are set to OFF and switching element QL1 through switching element QLn to ON so that reference potential A (0 (V) at this time) is applied to scan electrode SC1 through scan electrode SCn (not shown).

(Sub-Period T1)

In sub-period T1, input terminal IN4 is set to "Lo" so that switching element Q21 is set to OFF and resistor R13 is electrically open. Further, input terminal IN2 is set to "Hi" so that the operation of constant current generating circuit 61 is started. Thereby, a constant current flows toward capacitor C2, and the drain voltage of switching element Q2 falls toward negative voltage Vi4 (equal to voltage Va, in this exemplary embodiment) in a ramp form. The output voltage of scan electrode driving circuit 43 also starts to fall toward negative voltage Vi4 in a ramp form. At this time, the resistance of resistor R12 is preset so that the gradient of the ramp voltage becomes a desired value (e.g. −1 V/μsec).

This voltage drop can be continued in the period during which input terminal IN2 is set to "Hi" or until reference potential A reaches voltage Va. In this exemplary embodiment, when the output voltage of scan electrode driving circuit 43 has reached negative voltage Vi4 (equal to voltage Va, in this exemplary embodiment), 0 (V), for example, is input to input terminal IN2 so that input terminal IN2 is set to "Lo". In this manner, in this exemplary embodiment, erasing down-ramp voltage L5, which falls to voltage Vi4, is generated after generation of all the sustain pulses in the sustain period, and is applied to scan electrode SC1 through scan electrode SCn.

While this erasing down-ramp voltage L5 is falling, the voltage difference between scan electrodes 22 and data electrodes 32 exceeds the breakdown voltage in the discharge cells where unnecessary negative wall charge is accumulated on scan voltages 22 among the unlit discharge cells having undergone no sustain discharge. Thereby, a weak discharge occurs between such scan electrodes 22 and data electrodes 32. This weak discharge continues while erasing down-ramp voltage L5 is falling.

(Sub-Period T2)

In sub-period T2, input terminal IN3 of Miller integrating circuit 55 for generating erasing up-ramp voltage L3 is set to "Hi". Specifically, a predetermined constant current is input to input terminal IN3. Thereby, the constant current flows toward capacitor C3, the source voltage of switching element Q3 rises in a ramp form, and the output voltage of scan electrode driving circuit 43 starts to rise in a ramp form. At this time, the constant current to be input to input terminal IN3 is generated so that the gradient of the ramp voltage becomes a desired value (e.g. 10 V/μsec). In this manner, erasing up-ramp voltage L3 rising from 0 (V) toward voltage Vers (equal to voltage Vs, in this exemplary embodiment) is generated and applied to scan electrode SC1 through scan electrode SCn. This voltage rise can be continued in the period during which input terminal IN3 is set to "Hi" or until reference potential A reaches voltage Vers.

While this erasing up-ramp voltage L3 is rising, the voltage difference between scan electrode SCi and sustain electrode SUi exceeds the breakdown voltage. Thereby, a weak discharge occurs between scan electrode SCi and sustain electrode SUi. This weak discharge continues while erasing up-ramp voltage L3 is rising.

Though not shown in this chart, at this time, data electrode D1 through data electrode Dm are kept at 0 (V), and thus a positive wall voltage is formed on data electrode Dk.

(Sub-Period T3)

In sub-period T3, the clamp circuit of sustain pulse generating circuit 50 is operated to set reference potential A to 0 (V) in preparation for the subsequent all-cell initializing operation.

Next, a description is provided for the operation of generating an initializing waveform voltage in the all-cell initializing operation.

(Sub-Period T11)

In sub-period T11, switching element QH1 through switching element QHn are set to ON, and switching element QL1 through switching element QLn are set to OFF. Thereby, voltage Vc where voltage Vsc is superimposed on reference potential A (0 (V) at this time, thus voltage Vc=voltage Vsc) is applied to scan electrode SC1 through scan electrode SCn.

(Sub-Period T12)

Next, input terminal IN1 of Miller integrating circuit 53 for generating up-ramp voltage L1 is set to "Hi". Specifically, a predetermined constant current is input to input terminal IN1. The source voltage of switching Q1 immediately after the start of the operation of Miller integrating circuit 53 is voltage Vz, i.e. a voltage where Zener voltage Vz of Zener diode D10 is added to reference potential A (0 (V)). Therefore, the output voltage of scan electrode driving circuit 43 steeply rises from voltage Vsc to voltage Vi1, i.e. a voltage where Zener voltage Vz of Zener diode D10 is added to voltage Vsc.

Thereafter, the constant current flows toward capacitor C1, the source voltage of switching element Q1 rises from voltage Vi1 in a ramp form, and the output voltage of scan electrode driving circuit 43 starts to rise in a ramp form. At this time, the constant current to be input to input terminal IN1 is generated so that the gradient of the ramp voltage becomes a desired value (e.g. 1.3 V/μsec). In this manner, up-ramp voltage L1, which rises from V11 toward voltage Vi2 (equal to voltage Vsc+voltage Vr, in this exemplary embodiment), is generated and applied to scan electrode SC1 through scan electrode SCn. This voltage rise can be continued in the period during which input terminal IN1 is set to "Hi" or until reference potential A reaches voltage Vr.

In this manner, in sub-period T12, up-ramp voltage L1, which gently rises from voltage Vi1 toward Vi2 (equal to voltage Vs, in this exemplary embodiment) exceeding the breakdown voltage, is generated.

(Sub-Period T13)

In sub-period T13, input terminal IN1 is set to "Lo" so that the operation of Miller integrating circuit 53 is stopped. Switching element QH1 through switching element QHn are set to OFF and switching element QL1 through switching element QLn to ON to apply reference potential A to scan electrode SC1 through scan electrode SCn. Further, the clamp circuit of sustain pulse generating circuit 50 is operated to set reference potential A to voltage Vs. Thereby, the voltage of scan electrode SC1 through scan electrode SCn falls to voltage Vi3 (equal to voltage Vs, in this exemplary embodiment).

(Sub-Period T14)

In sub-period T14, input terminal IN4 is set to "Hi" so that switching element Q21 is set to ON and resistor R12 and resistor R13 are electrically connected in parallel with each other. Further, input terminal IN2 is set to "Hi" so that the operation of constant current generating circuit 61 is started. With this operation, the value of the constant current output from constant current generating circuit 61 becomes larger than that in sub-period T1. Then, a constant current flows from constant current generating circuit 61 toward capacitor C2, and the drain voltage of switching element Q2 falls toward negative voltage Vi4 (equal to voltage Va, in this exemplary embodiment) in a ramp form. The output voltage of scan electrode driving circuit 43 starts to fall toward negative voltage Vi4 in a ramp form with a gradient steeper than that of erasing down-ramp voltage L5. At this time, the combined resistance of resistor R12 and resistor R13 is preset so that the gradient of the ramp voltage becomes a desired value (e.g. −2.5 V/μsec).

This voltage drop can be continued in the period during which input terminal IN2 is set to "Hi" or until reference potential A reaches voltage Va. In this exemplary embodiment, when the output voltage of scan electrode driving circuit 43 reaches negative voltage Vi4 (equal to voltage Va, in this exemplary embodiment), input terminal IN2 is set to "Lo". In this manner, down-ramp voltage L2 (or down-ramp voltage L4), is generated and applied to scan electrode SC1 through scan electrode SCn.

In the above manner, scan electrode driving circuit 43 generates erasing down-ramp voltage L5, i.e. the second down-ramp voltage, erasing up-ramp voltage L3, up-ramp voltage L1, and down-ramp voltage L2 and down-ramp voltage L4, i.e. the first down-ramp voltages.

Each of down-ramp voltage L2, down-ramp voltage L4, and erasing down-ramp voltage L5 may be dropped to voltage Va as shown in FIG. 6. However, for example, the voltage drop may be stopped when the falling voltage reaches a voltage where predetermined positive voltage Vset2 is superimposed on voltage Va. Further, down-ramp voltage L2, down-ramp voltage L4, and erasing down-ramp voltage L5 may be raised immediately after having reached a preset voltage. However, for example, after the falling voltages have reached a preset low voltage, the low voltage may be maintained for a predetermined period.

As described above, in this exemplary embodiment, after the sustain pulses have been applied to the display electrode pairs in each sustain period, erasing down-ramp voltage L5, which has a gradient gentler than that of down-ramp voltage L2 and down-ramp voltage L4, is applied to scan electrode SC1 through scan electrode SCn. Thereby, an erasing discharge is caused in the discharge cells where unnecessary negative wall charge is accumulated on scan electrodes 22 among the unlit discharge cells having undergone no sustain discharge. This operation can remove the unnecessary negative wall charge accumulated in the unlit discharge cells having undergone no sustain discharge, and prevent an abnormal address discharge in addressing in the succeeding subfield. Thereby, deterioration of the image display quality can be prevented.

Figure 7:
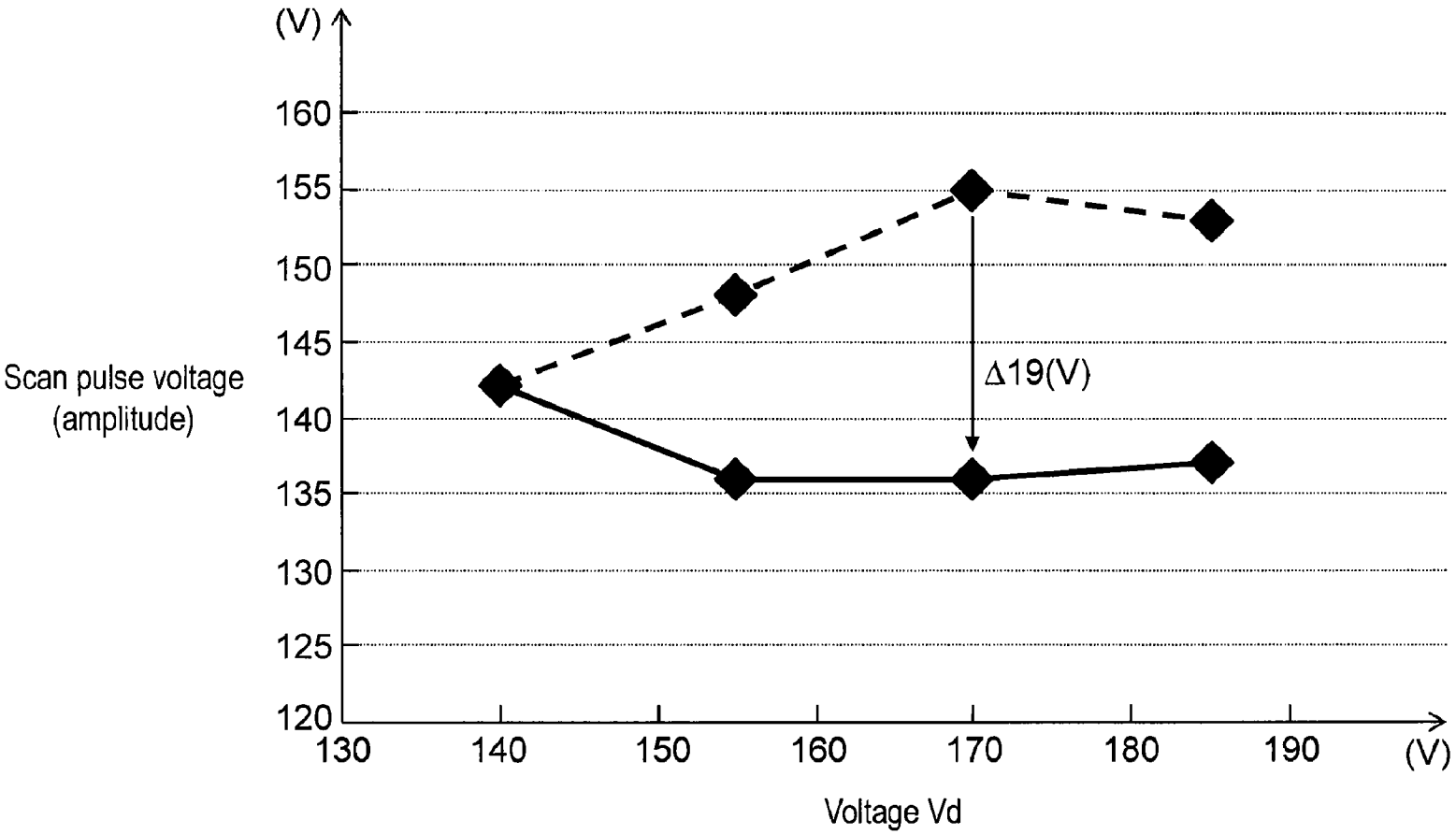
FIG. 7 is a characteristics chart showing the relation between address pulse voltage Vd and a scan pulse voltage (amplitude) in accordance with the first exemplary embodiment.

In this exemplary embodiment, it is verified that the advantage of reducing the scan pulse voltage (amplitude) necessary for causing a stable address discharge in the address periods can be provided. FIG. 7 is a characteristics chart showing the relation between address pulse voltage Vd and a scan pulse voltage (amplitude) in accordance with the first exemplary embodiment of the present invention. In FIG. 7, the horizontal axis shows address pulse voltage Vd; the vertical axis shows a scan pulse voltage (amplitude) necessary for causing a stable address discharge. In FIG. 7, the solid line shows the measurement result obtained when a panel is driven by the method of this exemplary embodiment; the broken line shows the measurement result obtained when 0 (V) instead of erasing down-ramp voltage L5 is applied to scan electrode SC1 through scan electrode SCn. As shown in FIG. 7, it is verified that the scan pulse voltage (amplitude) necessary for causing a stable address discharge is reduced by approximately 19 (V) when the panel is driven at address pulse voltage Vd of 170 (V) by the method of this exemplary embodiment. That is, in accordance with this exemplary embodiment, a stable address discharge can be caused without increasing the voltage necessary for causing an address discharge even in a high-definition panel.

In the structure described in this exemplary embodiment, erasing down-ramp voltage L5 is applied to scan electrode SC1 through scan electrode SCn in all the subfields. However, the present invention is not limited to this structure. For example, erasing down-ramp voltage L5 may be generated only in a subfield having a large luminance weight where unnecessary negative wall charge is likely to accumulate in the unlit discharge cells. For example, one field is formed of eight subfields (the first SF, the second SF through the eighth SF), and the respective subfields have luminance weights of 1, 2, 4, 8, 16, 32, 64, and 128. In this subfield structure, erasing down-ramp voltage L5 may be generated only in the sixth SF through the eighth SF having relatively large luminance weights. Even in such a structure where erasing down-ramp voltage L5 is generated only in the subfields having relatively large luminance weights, the advantages similar to the above can be obtained.

Figure 8:
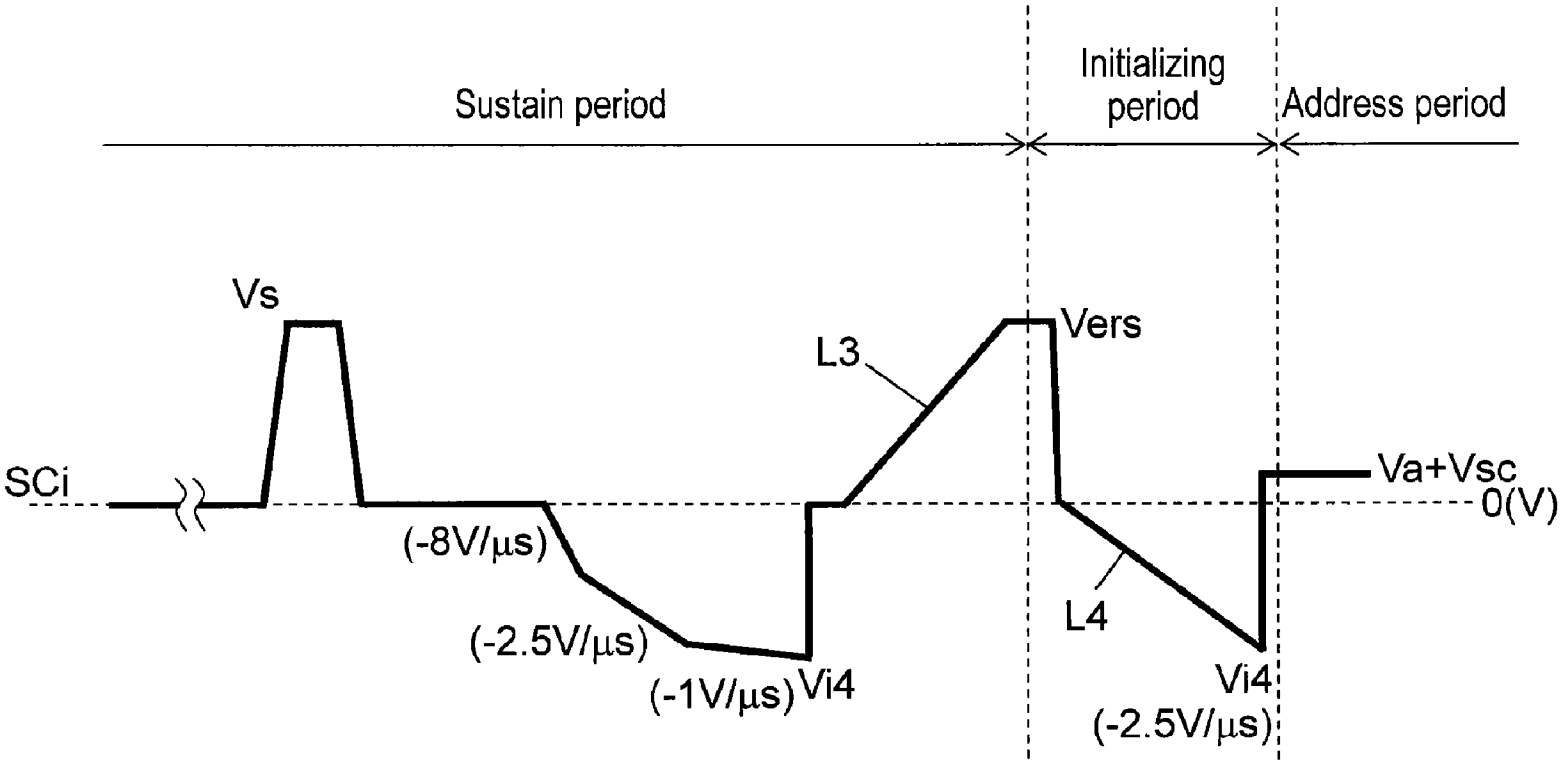
FIG. 8 is a waveform chart showing another waveform example of an erasing down-ramp voltage applied to the scan electrodes in accordance with the first exemplary embodiment.

In the structure described in this exemplary embodiment, erasing down-ramp voltage L5 is generated so as to have one gradient. However, for example, this exemplary embodiment may be structured so that erasing down-ramp voltage L5 is divided into a plurality of sub-periods and erasing down-ramp voltage L5 is generated to have different gradients in the respective sub-periods. FIG. 8 is a waveform chart showing another waveform example of erasing down-ramp voltage L5 applied to scan electrodes 22 in accordance with the first exemplary embodiment of the present invention. For example, as shown in FIG. 8, an erasing down-ramp voltage L5 may be generated so as to fall with the following gradients: until the occurrence of an erasing discharge, a gradient (e.g. −8 V/μsec) steeper than that of down-ramp voltage L2 and down-ramp voltage L4; thereafter, a gradient (e.g. −2.5 V/μsec) equal to that of down-ramp voltage L2 and down-ramp voltage L4; and at last, a gradient (e.g. −1 V/μsec) gentler than that of down-ramp voltage L2 and down-ramp voltage L4. It is verified that the advantages similar to the above can be obtained even in such a structure. Further, this structure can provide an advantage of shortening the period during which the erasing down-ramp voltage is generated.

Figure 9:
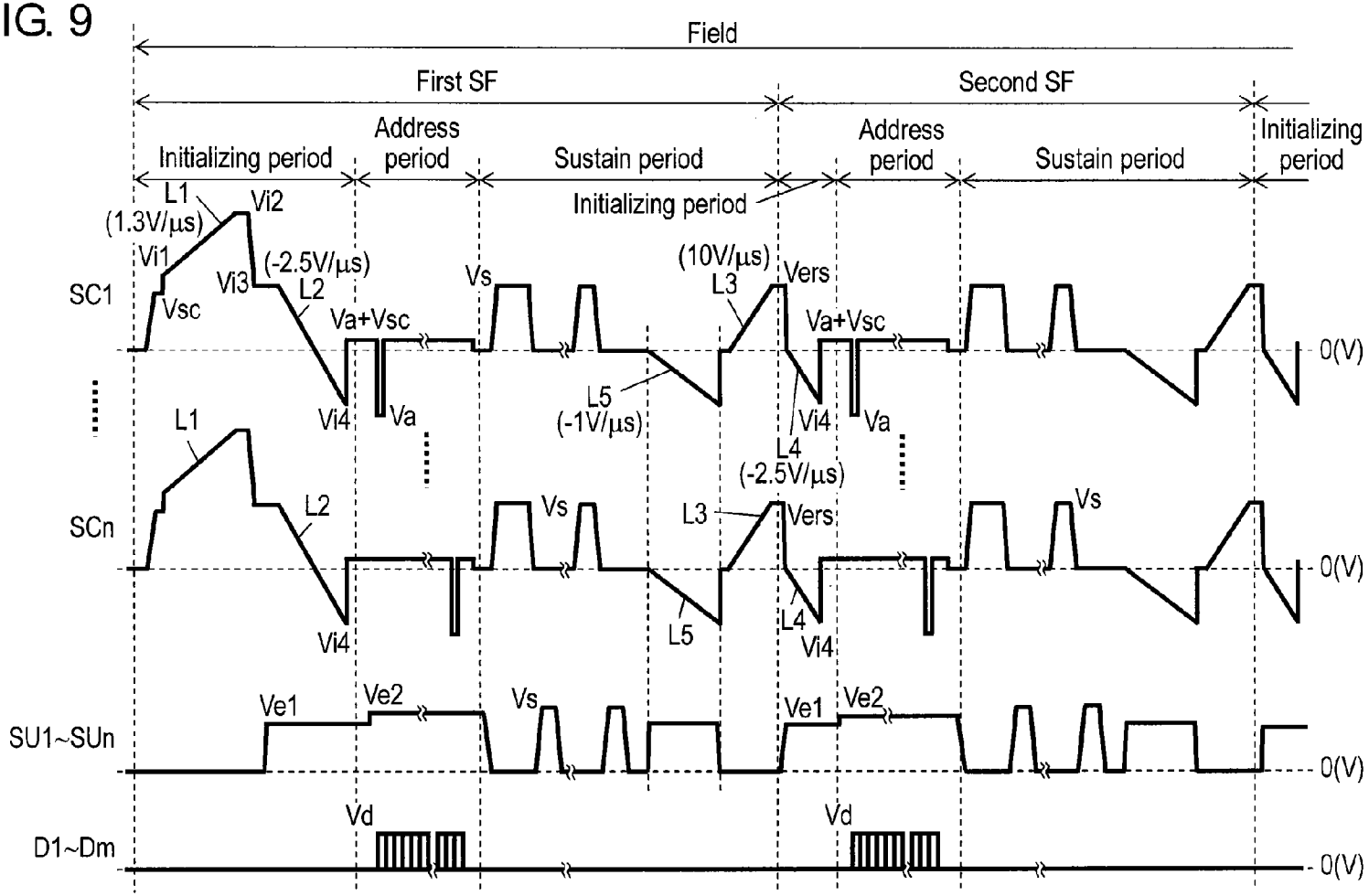
FIG. 9 is a waveform chart showing another example of driving voltage waveforms applied to the respective electrodes of the panel in accordance with the first exemplary embodiment.

In the structure described in this exemplary embodiment, 0 (V) is applied to sustain electrode SU1 through sustain electrode SUn in the period during which erasing down-ramp voltage L5 is applied to scan electrode SC1 through scan electrode SCn. However, the present invention is not limited to this structure. FIG. 9 is a waveform chart showing another example of driving voltage waveforms applied to the respective electrodes of the panel in accordance with the first exemplary embodiment of the present invention. For example, as shown in FIG. 9, this exemplary embodiment may be structured so that a predetermined voltage (e.g. a voltage equal to voltage Ve1) is applied to sustain electrode SU1 through sustain electrode SUn in the period during which erasing down-ramp voltage L5 is applied to scan electrode SC1 through scan electrode SCn.

The timing chart of FIG. 6 in this exemplary embodiment merely shows an example. The present invention is not limited to this timing chart.

Example 2

In the first exemplary embodiment, a description is provided for an example where erasing down-ramp voltage L5 is generated in a waveform shape having a gradient gentler than that of down-ramp voltage L2 and down-ramp voltage L4. However, in the present invention, the waveform shape of the erasing down-ramp voltage is not limited to the waveform shape of erasing down-ramp voltage L5. In this exemplary embodiment, a description is provided for an example where an erasing down-ramp voltage is generated in a waveform shape different from that of erasing down-ramp voltage L5.

Figure 10:
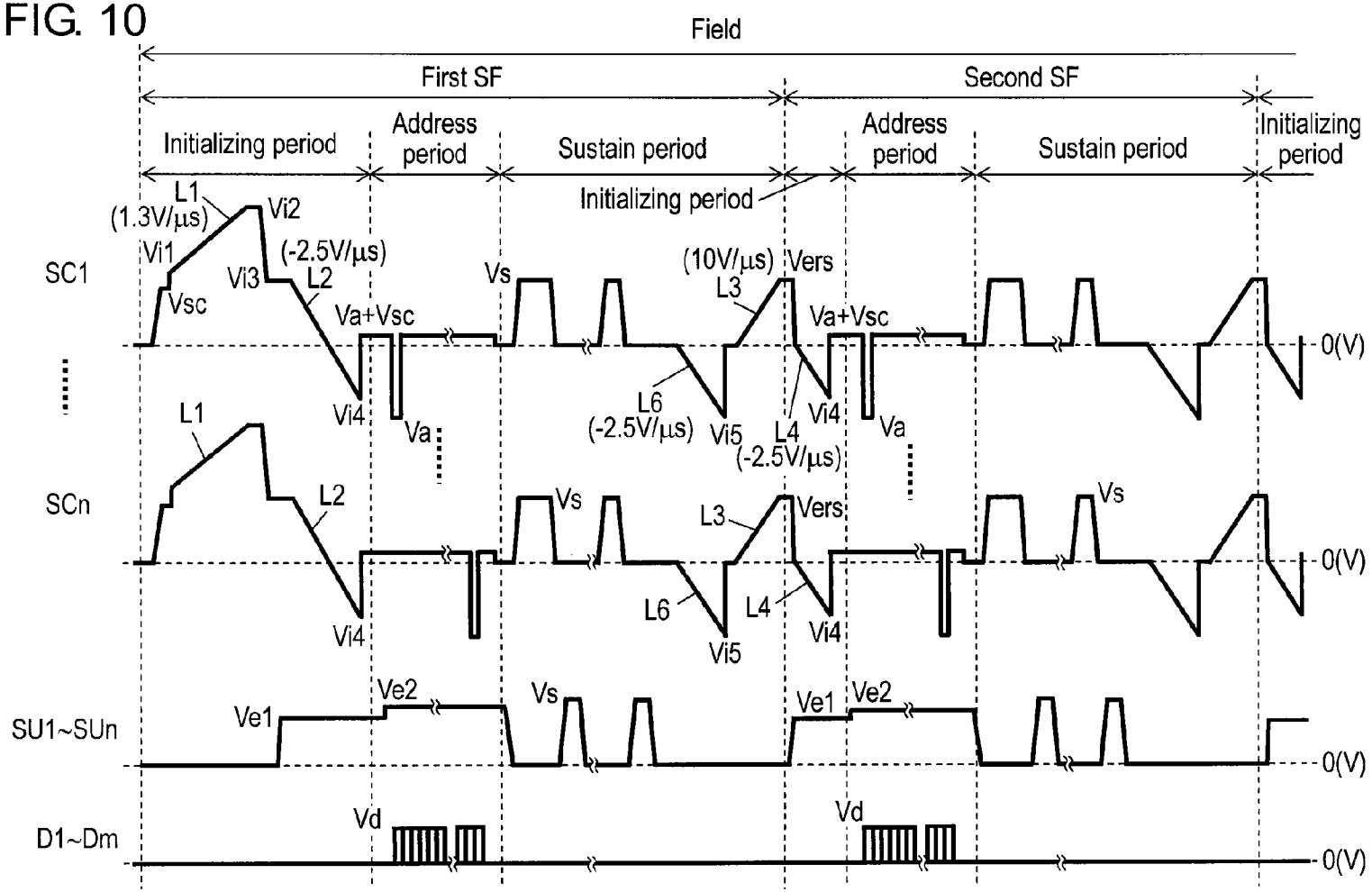
FIG. 10 is a waveform chart of driving voltages applied to the respective electrodes of the panel in accordance with a second exemplary embodiment of the present invention.

FIG. 10 is a waveform chart of driving voltages applied to the respective electrodes of panel 10 in accordance with the second exemplary embodiment of the present invention. In this exemplary embodiment, the erasing down-ramp voltage of this exemplary embodiment is referred to as "erasing down-ramp voltage L6". In this exemplary embodiment, instead of erasing down-ramp voltage L5, erasing down-ramp voltage L6 is used in a driving voltage waveform to be applied to scan electrode SC1 through scan electrode SCn. The other waveform shapes are similar to the driving voltage waveforms of FIG. 3 in the first exemplary embodiment. Therefore, in this exemplary embodiment, the description of the difference from the driving voltage waveforms of FIG. 3 is provided, and the description of the similarity to those of FIG. 3 is omitted.

In this exemplary embodiment, after sustain pulses have been generated in sustain periods, erasing down-ramp voltage L6, i.e. a third down-ramp voltage, is applied to scan electrode SC1 through scan electrode SCn. Here, erasing down-ramp voltage L6 gently falls from 0 (V) equal to or lower than the breakdown voltage toward negative voltage Vi5 exceeding the breakdown voltage with respect to data electrode D1 through data electrode Dm. At this time, in this exemplary embodiment, erasing down-ramp voltage L6 is generated so that voltage Vi5 is set to a voltage lower than voltage Vi4, which is a minimum voltage of down-ramp voltage L2 and down-ramp voltage L4 generated in initializing periods (voltage Vi4 being set to −166 (V), and voltage Vi5 to −168 (V), for example).

The following facts are verified. When the minimum voltage (voltage Vi4) of each of down-ramp voltage L2 and down-ramp voltage L4 is set too low, the wall charge is excessively adjusted and thus the subsequent address discharge is difficult to occur. When the minimum voltage (voltage Vi4) is set high, the wall charge is adjusted insufficiently and the subsequent address discharge occurs strongly, and thus the address operation is not performed properly. In consideration of these facts, preferably, the minimum voltage of down-ramp voltage L2 is set to an optimum voltage. In this exemplary embodiment, the minimum voltage of down-ramp voltage L2 is set to a voltage (e.g. −166 (V)) at which an address operation is performed stably.

On the other hand, the following facts are also verified. When the minimum voltage (voltage Vi5) of erasing down-ramp voltage L6 is set higher than voltage Vi4, the above abnormal discharge can occur in the subsequent application of down-ramp voltage L2 or down-ramp voltage L4. This is considered because down-ramp voltage L2 or down-ramp voltage L4 falls to a voltage lower than the minimum voltage (voltage Vi5) of erasing down-ramp voltage L6. In contrast, when the minimum voltage (voltage Vi5) of erasing down-ramp voltage L6 is set too low, the wall charge is excessively erased by the erasing discharge, and the subsequent address discharge is difficult to occur.

Then, in this exemplary embodiment, the minimum voltage (voltage Vi5) of erasing down-ramp voltage L6 is set in consideration of the following conditions:

providing a sufficient advantage of removing unnecessary wall charge, i.e. a cause of a false discharge;

preventing occurrence of an abnormal discharge in application of down-ramp voltage L2 and down-ramp voltage L4; and not hindering the occurrence of the subsequent address discharge.

In this exemplary embodiment, the minimum voltage (voltage Vi5) of erasing down-ramp voltage L6 is set in the range where the above advantages can be obtained. Specifically, the minimum voltage (voltage Vi5) of erasing down-ramp voltage L6 is set in the range lower than voltage Vi4 and equal to higher than voltage Vi4 minus 2 (V). It is verified that the above advantages can be obtained with this setting.

FIG. 10 shows an example where the gradient of erasing down-ramp voltage L6 is equal to the gradient of down-ramp voltage L2 and down-ramp voltage L4 (e.g. approximately −2.5 V/μsec). However, in this exemplary embodiment, the gradient of erasing down-ramp voltage L6 is not limited to this value. This exemplary embodiment merely shows a structure where the minimum voltage (voltage Vi5) of erasing down-ramp voltage L6 is set within the above range, in order to provide the above advantages. Therefore, for example, the gradient of erasing down-ramp voltage L6 may be set to a gradient gentler than that of down-ramp voltage L2 and down-ramp voltage L4, similar to that of erasing down-ramp voltage L5. In this structure, both of the advantages of the first exemplary embodiment and the advantages of the second exemplary embodiment can be obtained.

Figure 11:
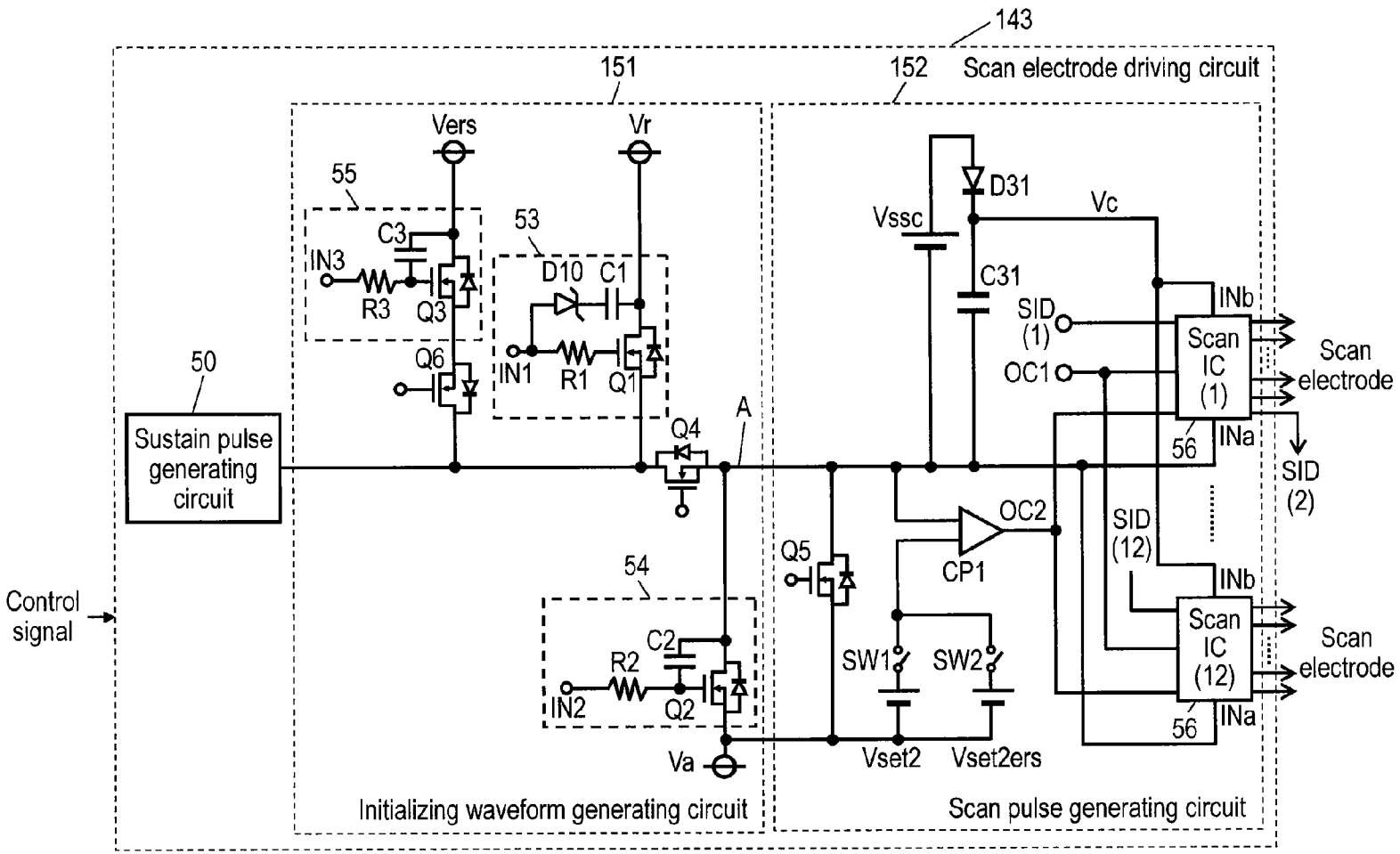
FIG. 11 is a circuit diagram showing a configuration example of a scan electrode driving circuit in accordance with the second exemplary embodiment.

FIG. 11 is a circuit diagram showing a configuration example of scan electrode driving circuit 143 in accordance with the second exemplary embodiment of the present invention. Scan electrode driving circuit 143 has sustain pulse generating circuit 50, initializing waveform generating circuit 151, and scan pulse generating circuit 152. Each output terminal of scan pulse generating circuit 152 is connected to corresponding one of scan electrode SC1 through scan electrode SCn of panel 10. The elements similar to those in initializing waveform generating circuit 51 of the first exemplary embodiment are denoted with the same reference signs and the description thereof is omitted.

Similar to initializing waveform generating circuit 51 of the first exemplary embodiment, initializing waveform generating circuit 151 has Miller integrating circuit 53, Miller integrating circuit 54, and Miller integrating circuit 55.

Miller integrating circuit 54 has switching element Q2, capacitor C2, and resistor R2. In the initializing operation, this Miller integrating circuit 54 generates down-ramp voltage L2 and down-ramp voltage L4, by causing reference potential A to fall to voltage Vi4 gently (with a gradient of −2.5 V/μsec, for example) in a ramp form. After the sustain pulses have been generated in sustain periods, this Miller integrating circuit 54 generates erasing down-ramp voltage L6, by causing reference potential A to fall to voltage Vi5, which is lower than minimum voltage Vi4 of down-ramp voltage L2 and down-ramp voltage L4, with a gradient equal to that of down-ramp voltage L2 and down-ramp voltage L4 (e.g. −2.5 V/μsec).

In addition to the structure of scan pulse generating circuit 52 of FIG. 5 in the first exemplary embodiment, which includes a plurality of scan ICs 56 (scan IC 56 (1) through scan IC 56 (12), in this exemplary embodiment) for outputting a scan pulse to scan electrode SC1 through scan electrode SCn, scan pulse generating circuit 152 has the following elements:

comparator CP1 for comparing the magnitudes of the input signals input to two input terminals thereof;

switching element SW1 for applying voltage (Va+Vset2) to one of the input terminals of comparator CP1; and switching element SW2 for applying voltage (Va+Vset2ers) to the one of the input terminals of comparator CP1.

The other one of the input terminals of CP1 is connected to reference potential A. Reference potential A is connected to the low voltage side (input terminal INa) of each scan IC 56.

Each scan IC 56 has two input terminals: input terminal INa, i.e. the input terminal on the low voltage side; and input terminal INb, i.e. the input terminal on the high voltage side. According to control signals input to scan IC 56, each scan IC 56 outputs either one of the signals input to the two input terminals. As the control signals, control signal OC1 output from control signal generating circuit 45, control signal OC2 output from comparator CP1 are input to each scan IC 56. Scan start signal SID (1) output from control signal generating circuit 45 immediately after the start of each address period is input to scan IC 56 (1) for performing scanning first in the address period. Clock signal CLK (not shown in FIG. 11), i.e. a synchronizing signal for synchronizing signal processing operation, is input to all scan ICs 56 (scan IC 56 (1) through scan IC 56 (12), in this exemplary embodiment).

Figure 12:
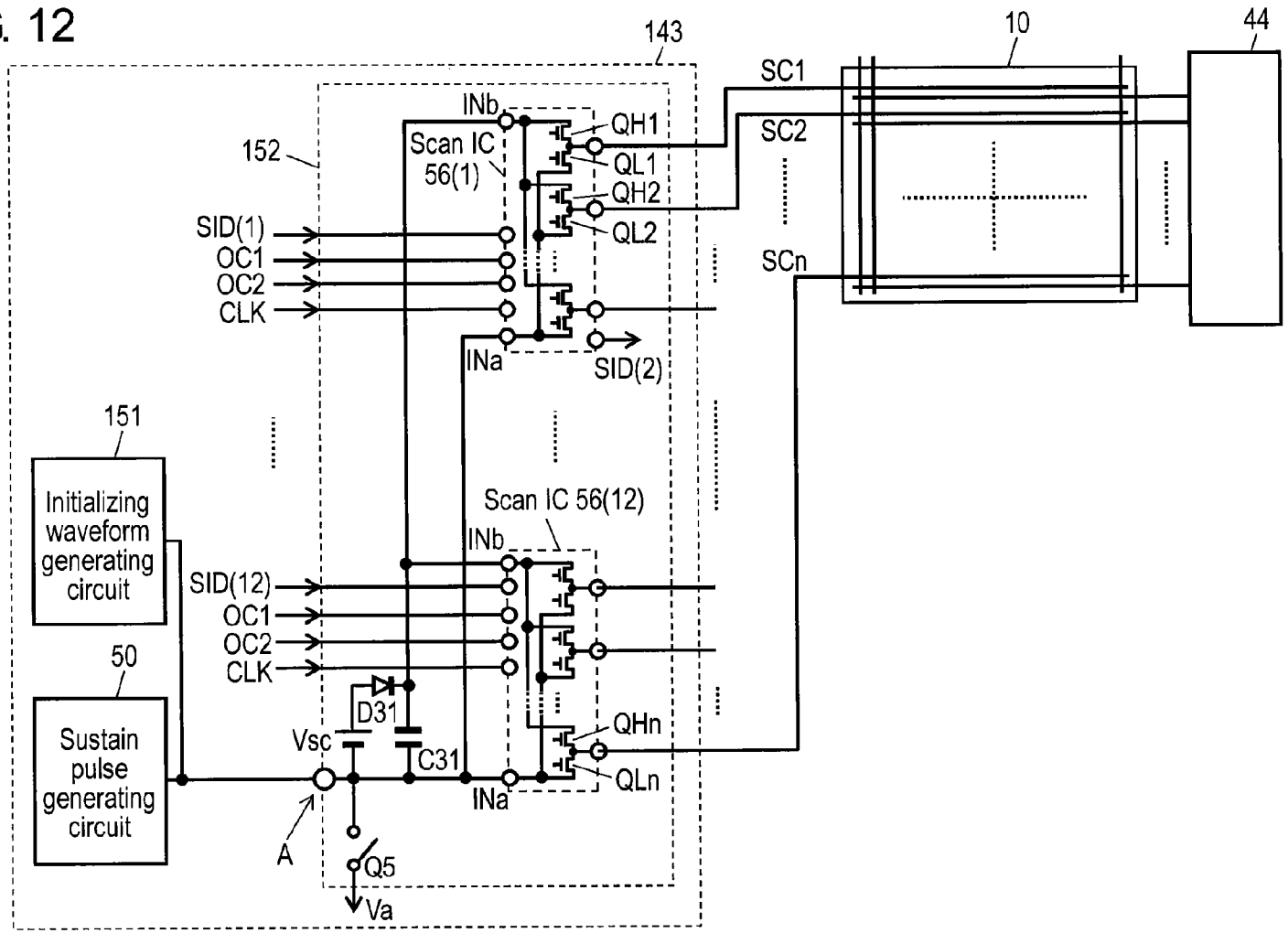
FIG. 12 is a schematic diagram showing how scan integrated circuits (ICs) of the scan electrode driving circuit are connected to the scan electrodes in accordance with the second exemplary embodiment.

FIG. 12 is a schematic diagram showing how scan ICs 56 of scan electrode driving circuit 143 are connected to scan electrode SC1 through scan electrode SCn in accordance with the second exemplary embodiment of the present invention. In FIG. 12, the circuits other than scan ICs 56 are omitted.

Similar to scan pulse generating circuit 52, scan pulse generating circuit 152 has switching element QH1 through switching element QHn and switching element QL1 through switching element QLn for applying a scan pulse voltage to n scan electrode SC1 through scan electrode SCn, respectively. Switching element QH1 through switching element QHn and switching element QL1 through switching element QLn are grouped in a plurality of outputs and formed into ICs. These ICs are scan ICs 56.

For example, in this exemplary embodiment, switching elements for 90 outputs are integrated into one monolithic IC, as scan IC 56. When panel 10 has 1,080 scan electrodes 22, 12 scan ICs, i.e. IC 56 (1) through scan IC 56 (12), form scan pulse generating circuit 152 and drive 1,080 electrodes, i.e. scan electrode SC1 through scan electrode SCn. In this manner, integrating a large number of switching element QH1 through switching element QHn and switching element QL1 through switching element QLn into ICs can reduce the number of components and thus the mounting area. However, the numerical values shown in this exemplary embodiment are merely examples, and the present invention is not limited to these values.

FIG. 13 is a chart showing the correlation between control signal OC1 and control signal OC2 and an operation state of scan ICs 56 in accordance with the second exemplary embodiment of the present invention.

As shown in FIG. 13, when control signal OC1 and control signal OC2 are both at a high level (hereinafter, referred to as "Hi"), scan ICs 56 are in "All-Hi" state. In scan ICs 56 in "All-Hi" state, switching element QH1 through switching element QHn are set to ON and switching element QL1 through switching element QLn are set to OFF, and thus all the output terminals of scan ICs 56 are electrically connected to input terminals INb on the high voltage sides.

When control signal OC1 is at "Hi" and control signal OC2 is at a low level (hereinafter, "Lo"), scans IC 56 are in "All-Lo" state. In scan ICs 56 in "All-Lo" state, switching element QH1 through switching element QHn are set to OFF and switching element QL1 through switching element QLn are set to ON, and thus all the output terminals of scan ICs 56 are electrically connected to input terminals INa on the low voltage sides. For example, when sustain pulse generating circuit 50 is operated, scan ICs 56 are brought into "All-Lo" state. Thereby, the sustain pulses output from scan pulse generating circuit 50 can be applied to scan electrode SC1 through scan electrode SCn via switching element QL1 through switching element QLn, respectively.

When control signal OC1 and control signal OC2 are both at "Lo", the output terminals of scan ICs 56 are in a high impedance state (hereinafter, "HiZ").

When control signal OC1 is at "Lo" and control signal OC2 is at "Hi", scan ICs 56 are in "DATA" state. Scan ICs 56 in "DATA" state perform a predetermined series of operations in response to scan start signals input to scan ICs 56.

Specifically, when scan start signal SID is input to scan IC 56 (when scan start signal SID is kept at "Lo" for a predetermined period, in this exemplary embodiment), first, only the first output terminal of scan IC 56 is electrically connected to input terminal INa on the low voltage side, and all the remaining output terminals are electrically connected to input terminal INb on the high voltage side. After the state has been kept for a predetermined period (e.g. 1 μsec), next, only the second output terminal of scan IC 56 is electrically connected to input terminal INa on the low voltage side, and all the remaining output terminals are electrically connected to input terminal INb on the high voltage side. In this manner, each output terminal of scan IC 56 is electrically connected to input terminal INa on the low voltage side for a predetermined period in order.

In the address periods, switching element Q5 is set to ON so that reference potential A is equal to negative voltage Va. Negative voltage Va is input to input terminal INa; voltage Vc, i.e. voltage Va+voltage Vsc, is input to input terminal INb. Thus, to scan electrode SCi to be applied with a scan pulse, negative scan pulse Va is applied via switching element QLi. To scan electrode SCh (h being 1 through n except i) to be applied with no scan pulse, voltage Va+voltage Vsc is applied via switching element QHh.

In this manner, with scan ICs 56 brought into "DATA" state in the address period, a scan pulse can be sequentially generated and applied to scan electrode SC1 through scan electrode SCn.

In this exemplary embodiment, scan start signal SID (1) that is used for scan IC 56 for performing scanning first in the address periods (e.g. scan IC 56 (1)) is generated in control signal generating circuit 45. Each of the remaining scan start signals (e.g. scan start signal SID (2) used for scan IC 56(2) through scan start signal SID (12) used for scan IC 56 (12)) is generated in corresponding one of scan ICs 56.

Specifically, after having applied a scan pulse to all scan electrodes 22 connected to scan IC 56 (1), scan IC 56 (1) delays scan start signal SID (1) by a predetermined time, using a shift register, for example, to generate scan start signal SID (2) and supply the generated SID to scan IC 56 (2) at the next stage. Similarly, scan IC 56 (2) delays scan start signal SID (2) by a predetermined time, to generate scan start signal SID (3) and supply the generated SID to scan IC 56 (3) at the next stage. Similarly, each scan IC 56 delays the input scan start signal by a predetermined time, to generate a new scan start signal and supply the new scan start signal to scan IC 56 at the next stage.

Figure 14:
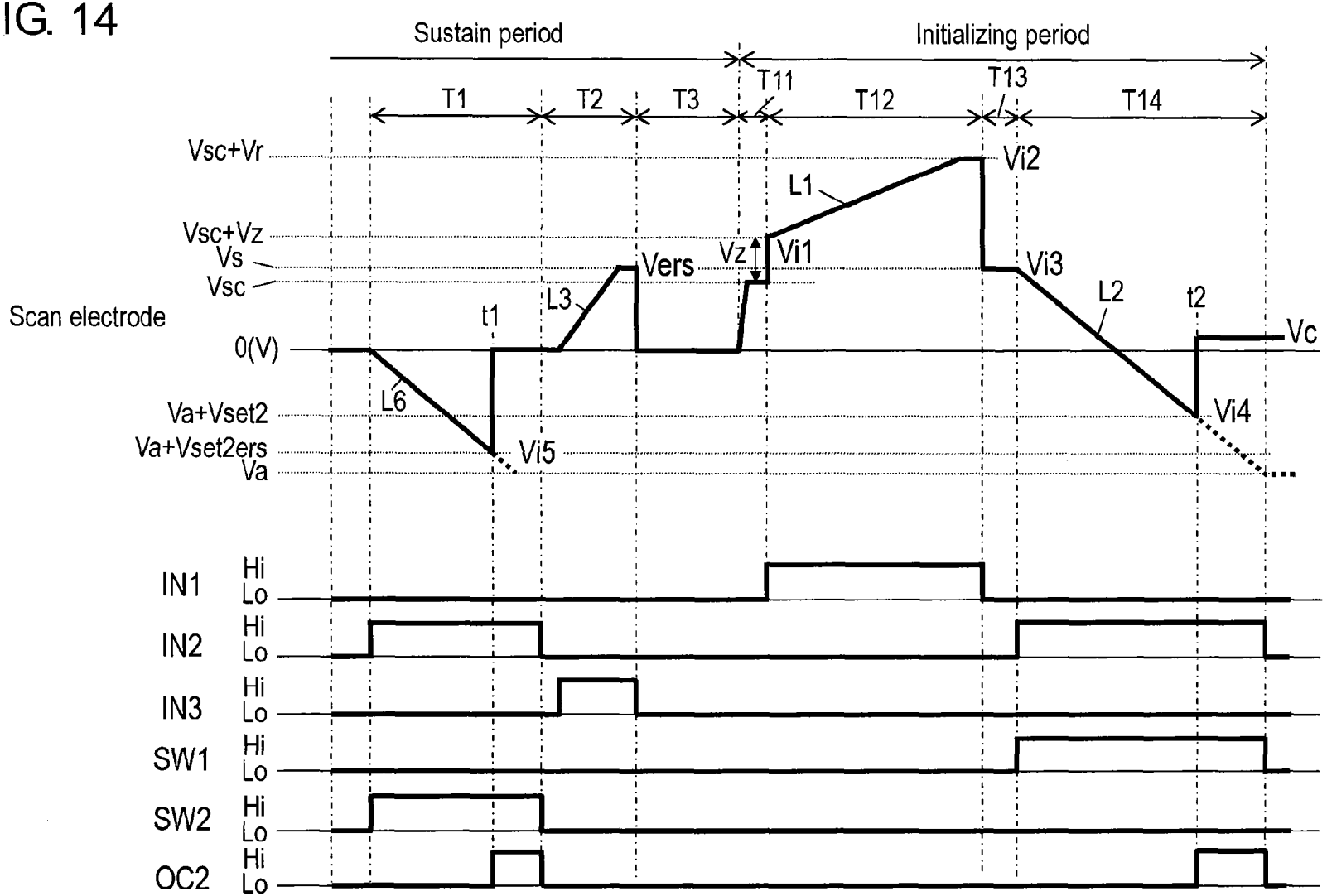
FIG. 14 is timing chart for explaining an example of the operation of the scan electrode driving circuit in an all-cell initializing period in accordance with the second exemplary embodiment.

Next, a description is provided for the operation of generating down-ramp voltage L2, i.e. a first down-ramp voltage, which falls to voltage Vi4, and the operation of generating erasing down-ramp voltage L6, i.e. a third down-ramp voltage, which falls to voltage Vi5, with reference to FIG. 14.

FIG. 14 is timing chart for explaining an example of the operation of scan electrode driving circuit 143 in an all-cell initializing period in accordance with the second exemplary embodiment of the present invention. In this chart, a driving waveform in the all-cell initializing operation is described as an example. The operation of generating down-ramp voltage L4 in a selective initializing operation is similar to the operation of generating down-ramp voltage L2 as described with reference to FIG. 14.

In FIG. 14, the driving waveform at the end of the sustain period is divided into three sub-periods shown by sub-period T1 through sub-period T3, and the driving waveform for the all-cell initializing operation is divided into four sub-periods shown by sub-period T11 through sub-period T14. Each sub-period is described. In the following description, Voltage Vi3 is equal to voltage Vs, voltage Vi2 is equal to voltage Vsc+voltage Vr, voltage Vi4 is equal to voltage (Va+Vset2), and voltage Vi5 is equal to voltage (Va+Vset2ers).

Hereinafter, a description is provided for the operation of generating erasing down-ramp voltage L6 after generating the sustain pulses in the sustain period, and thereafter generating down-ramp voltage L2.

First, before sub-period T1, the clamp circuit of sustain pulse generating circuit 50 is operated to set reference potential A to 0 (V). Next, switching element QH1 through switching element QHn are set to OFF and switching element QL1 through switching element QLn to ON so that reference potential A (0 (V) at this time) is applied to scan electrode SC1 through scan electrode SCn (not shown). Control signal OC1 is set to "Hi" (not shown).

(Sub-Period T1)

In sub-period T1, input terminal IN2 of Miller integrating circuit 54 for generating a down-ramp voltage is set to "Hi". Specifically, a predetermined constant current is input to input terminal IN2. Then, a constant current flows from resistor R2 toward capacitor C2, the drain voltage of switching element Q2 falls toward negative voltage Vi5 (equal to voltage (Va+Vset2ers), in this exemplary embodiment) in a ramp form, and the output voltage of scan electrode driving circuit 143 also starts to fall in a ramp form. At this time, the constant current to be input to input terminal IN2 is generated so that the gradient of the ramp voltage becomes a desired value (e.g. −2.5 V/μsec).

In this exemplary embodiment, erasing down-ramp voltage L6 is generated so that the minimum voltage thereof is voltage (Va+Vset2ers). For this purpose, in sub-period T1, switching element SW2 is set to ON and switching element SW1 to OFF, and thus voltage (Va+Vset2ers) is applied to one of the terminals of comparator CP1. Then, in comparator CP1, reference potential A, i.e. a down-ramp voltage output from initializing waveform generating circuit 151, is compared to voltage (Va+Vset2ers) where voltage Vset2ers is superimposed on voltage Va.

With this operation, the output signal from comparator CP1, i.e. control signal OC2, switches from "Lo" to "Hi" at time t1 when the down-ramp voltage at reference potential A becomes equal to or lower than voltage (Va+Vset2ers). That is, in sub-period T1, control signal OC1 is at "Hi" and control signal OC2 is at "Lo" before time t1, and thus scan ICs 56 are in "All-Lo" state. After time t1, control signal OC1 and control signal OC2 are both at "Hi", and thus scan ICs 56 are in "All-Hi" state. Therefore, at time t1, the voltage output from scan ICs 56 switches from the down-ramp voltage output from initializing waveform generating circuit 151 to the voltage input to input terminals INb (a voltage where voltage Vsc is superimposed on reference potential A). As a result, the voltage drop before that time changes to a voltage rise.

In this manner, in this exemplary embodiment, erasing down-ramp voltage L6, which falls to voltage (Va+Vset2ers), is generated after all the sustain pulses have been generated in the sustain period and applied to scan electrode SC1 through scan electrode SCn. While this erasing down-ramp voltage L6 is falling, the voltage difference between scan electrodes 22 and data electrodes 32 exceeds the breakdown voltage. Thereby, a weak discharge is caused between scan electrodes 22 and data electrodes 32, and can be continued while erasing down-ramp voltage L6 is falling.

Similarly to the description in the first exemplary embodiment, this weak discharge occurs only in the discharge cells where unnecessary negative wall charge is accumulated on scan electrodes 22 among the unlit discharge cells having undergone no address discharge and no sustain discharge. This weak discharge does not occur in the lit discharge cells having undergone an address discharge, or in the unlit discharge cells where only a small amount of unnecessary negative wall charge is accumulated on scan electrodes 22.

Subsequently, after erasing down-ramp voltage L6 has fallen to voltage (Va+Vset2ers), the operation of Miller integrating circuit 54 is stopped by applying 0 (V), for example, to input terminal IN2 so that input terminal IN2 is set to "Lo".

(Sub-Period T2 Through Sub-Period T13)

The operations in sub-period T2, sub-period T3, sub-period T11, sub-period T12, and sub-period T13 are similar to those in sub-period T2, sub-period T3, sub-period T11, sub-period T12, and sub-period T13 described with reference to FIG. 6, and thus the description is omitted.

(Sub-Period T14)

In sub-period T14, input terminal IN2 of Miller integrating circuit 54 for generating a down-ramp voltage is set to "Hi". Specifically, a predetermined constant current is input to input terminal IN2. Then, a constant current flows from resistor R2 toward capacitor C2, and the drain voltage of switching element Q2 falls toward negative voltage Vi4 (equal to voltage (Va+Vset2), in this exemplary embodiment) in a ramp form. The output voltage of scan electrode driving circuit 143 also starts to fall in a ramp form. At this time, the constant current to be input to input terminal IN2 is generated so that the gradient of the ramp voltage becomes a desired value (e.g. −2.5 V/μsec).

In this exemplary embodiment, down-ramp voltage L2 is generated so that potential Vi4 is set to voltage (Va+Vset2). For this purpose, in sub-period T14, switching element SW1 is set to ON and switching element SW2 to OFF, and thus voltage (Va+Vset2) is applied to the one of the terminals of comparator CP1. Then, in comparator CP1, reference potential A, i.e. a down-ramp voltage output from initializing waveform generating circuit 151, is compared to voltage (Va+Vset2) where voltage Vset2 is superimposed on voltage Va.

With this operation, control signal OC2, i.e. the output signal from comparator CP1, switches from "Lo" to "Hi" at time t2 when the down-ramp voltage at reference potential A becomes equal to or lower than voltage (Va+Vset2). That is, in sub-period T14, control signal OC1 is at "Hi" and control signal OC2 is at "Lo" before time t2, and thus scan ICs 56 are in "All-Lo" state. After time t2, control signal OC1 and control signal OC2 are both at "Hi", and thus scan ICs 56 are in "All-Hi" state. Therefore, at time t2, the voltage output from scan ICs 56 switches from the down-ramp voltage output from initializing waveform generating circuit 151 to the voltage input to input terminals INb (a voltage where voltage Vsc is superimposed on reference potential A). As a result, the voltage drop before that time changes to a voltage rise.

In this manner, in this exemplary embodiment, down-ramp voltage L2 (or down-ramp voltage L4), which falls to voltage (Va+Vset2), is generated and applied to scan electrode SC1 through scan electrode SCn.

In the above manner, scan electrode driving circuit 143 generates erasing down-ramp voltage L6, i.e. the third down-ramp voltage, and down-ramp voltage L2 and down-ramp voltage L4, i.e. the first down-ramp voltages, so that these voltages have different minimum voltages.

Each of down-ramp voltage L2, down-ramp voltage L4, and erasing down-ramp voltage L6 may be raised immediately after having reached a preset voltage as shown in FIG. 14. However, for example, after the falling voltage has reached the preset voltage, the voltage may be maintained for a predetermined period.

As described above, in this exemplary embodiment, after the sustain pulses have been applied to display electrode pairs 24 in each sustain period, erasing down-ramp voltage L6, which has a minimum voltage (voltage Vi5) lower than the minimum voltage (Vi4) of down-ramp voltage L2 and down-ramp voltage L4, is applied to scan electrode SC1 through scan electrode SCn. Thereby, an erasing discharge is caused in the discharge cells where unnecessary negative wall charge is accumulated on scan electrodes 22 among the unlit discharge cells having undergone no sustain discharge. This operation can remove the unnecessary negative wall charge accumulated in the unlit discharge cells having undergone no sustain discharge, and prevent an abnormal address discharge in addressing in the succeeding subfield. Thereby, deterioration of the image display quality can be prevented.

Further, in this exemplary embodiment, the minimum voltage (voltage Vi5) of erasing down-ramp voltage L6 is set in the range lower than the minimum voltage (voltage Vi4) of down-ramp voltage L2 and down-ramp voltage L4 and equal to or higher than voltage Vi4 minus 2 (V). This setting can provide the following advantages: providing a sufficient advantage of removing the unnecessary wall charge, i.e. a cause of a false discharge; preventing an abnormal discharge in application of down-ramp voltage L2 and down-ramp voltage L4; and not hindering the subsequent address discharge.

Further, in this exemplary embodiment, it is also verified that the advantage of reducing the scan pulse voltage (amplitude) necessary for causing a stable address discharge in the address periods can be obtained. At address pulse voltage Vd of 170 (V), for example, the measurement result obtained when a panel is driven in accordance with this exemplary embodiment is compared to the measurement result obtained when 0 (V) instead of erasing down-ramp voltage L6 is applied to scan electrode SC1 through scan electrode SCn. As a result, it is verified that the scan pulse voltage (amplitude) necessary for causing a stable address discharge can be reduced by approximately 19 (V) when the panel is driven in accordance with this exemplary embodiment. That is, in accordance with this exemplary embodiment, a stable address discharge can be caused without increasing the voltage necessary for causing an address discharge even in a high-definition panel.

In the structure described in this exemplary embodiment, erasing down-ramp voltage L6 is applied to scan electrode SC1 through scan electrode SCn in all the subfields. However, the present invention is not limited to this structure. For example, erasing down-ramp voltage L6 may be generated only in a subfield having a large luminance weight where unnecessary negative wall charge is likely to accumulate in the unlit discharge cells. For example, one field is formed of eight subfields (the first SF, the second SF through the eighth SF), and the respective subfields have luminance weights of 1, 2, 4, 8, 16, 32, 64, and 128. In this subfield structure, erasing down-ramp voltage L6 may be generated only in the sixth SF through the eighth SF having relatively large luminance weights. Even in such a structure where erasing down-ramp voltage L6 is generated only in the subfields having relatively large luminance weights, the advantages similar to the above can be obtained.

Figure 15:
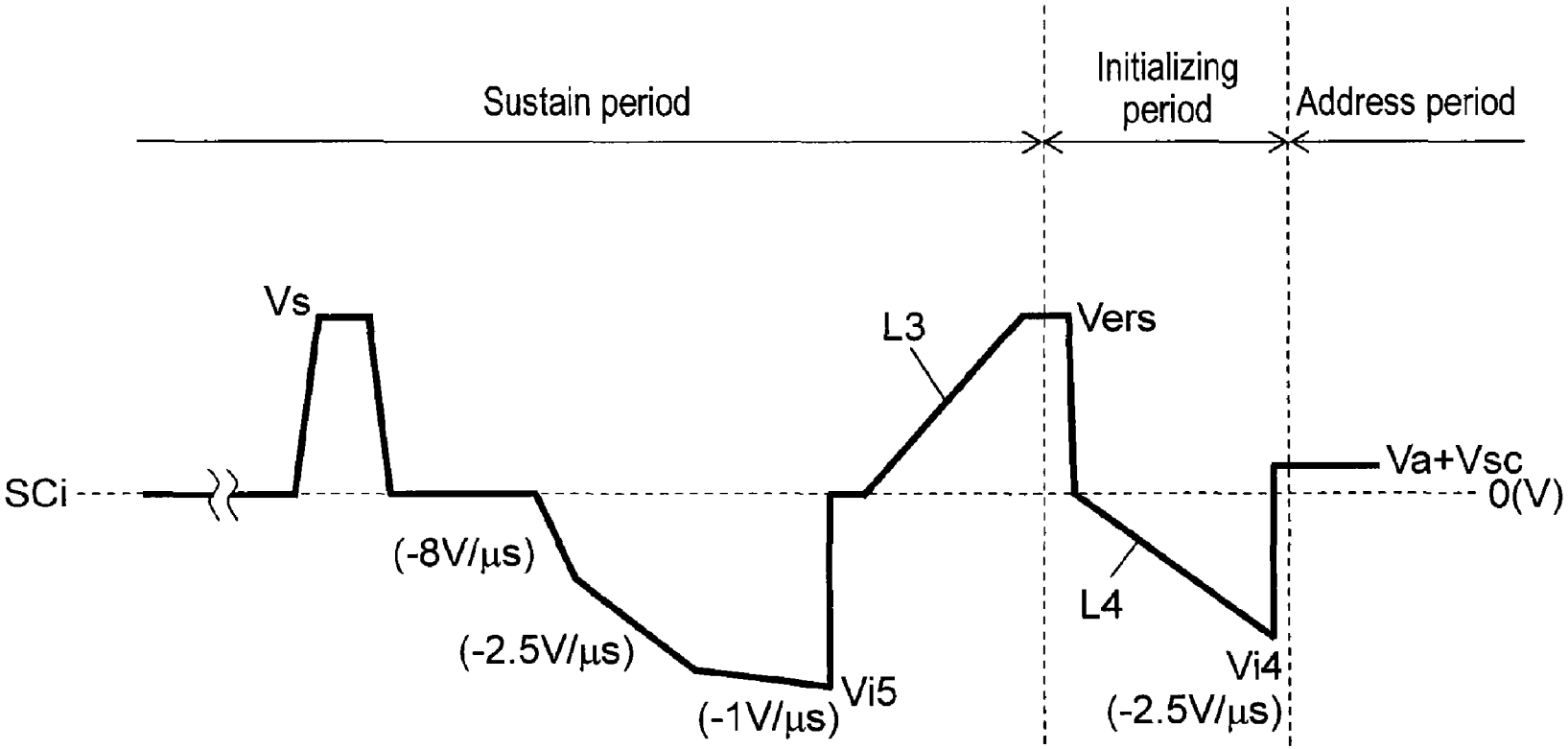
FIG. 15 is a waveform chart showing another waveform example of an erasing down-ramp voltage applied to the scan electrodes in accordance with the second exemplary embodiment.

In the structure described in this exemplary embodiment, erasing down-ramp voltage L6 is generated so as to have one gradient. However, for example, the exemplary embodiment may be structured so that erasing down-ramp voltage L6 is divided into a plurality of sub-periods and erasing down-ramp voltage L6 is generated to have different gradients in the respective sub-periods. FIG. 15 is a waveform chart showing another waveform example of erasing down-ramp voltage L6 applied to scan electrodes 22 in accordance with the second exemplary embodiment of the present invention. For example, as shown in FIG. 15, an erasing down-ramp voltage may be generated so as to fall with the following gradients: until the occurrence of an erasing discharge, a gradient (e.g. −8 V/μsec) steeper than that of down-ramp voltage L2 and down-ramp voltage L4; thereafter, a gradient (e.g. −2.5 V/μsec) equal to that of down-ramp voltage L2 and down-ramp voltage L4; and at last, a gradient (e.g. −1 V/μsec) gentler than that of down-ramp voltage L2 and down-ramp voltage L4. It is verified that the advantages similar to the above can be obtained even in such a structure. Further, this structure can provide an advantage of shortening the period during which the erasing down-ramp voltage is generated.

Figure 16:
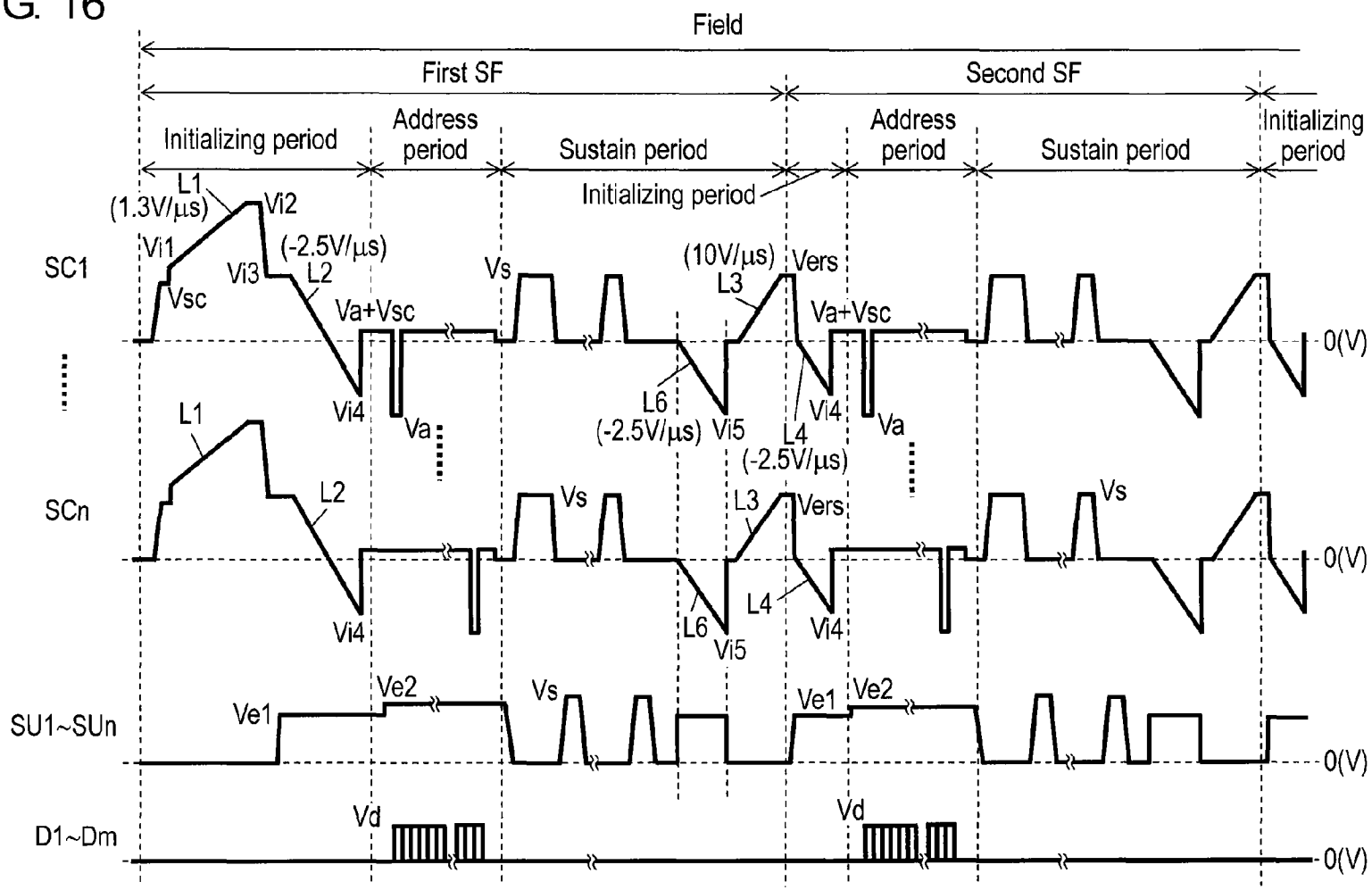
FIG. 16 is a waveform chart showing another example of driving voltage waveforms applied to the respective electrodes of the panel in accordance with the second exemplary embodiment.

In the structure described in this exemplary embodiment, 0 (V) is applied to sustain electrode SU1 through sustain electrode SUn in the period during which erasing down-ramp voltage L6 is applied to scan electrode SC1 through scan electrode SCn. However, the present invention is not limited to this structure. FIG. 16 is a waveform chart showing another example of driving voltage waveforms applied to the respective electrodes of the panel in accordance with the second exemplary embodiment of the present invention. For example, as shown in FIG. 16, this exemplary embodiment may be structured so that a predetermined voltage (e.g. a voltage equal to voltage Ve1) is applied to sustain electrode SU1 through sustain electrode SUn in the period during which erasing down-ramp voltage L6 is applied to scan electrode SC1 through scan electrode SCn.

The timing chart of FIG. 14 in this exemplary embodiment merely shows an example. The present invention is not limited to this timing chart.

In the structures described in the exemplary embodiments of the present invention, erasing down-ramp voltage L5 (or erasing down-ramp voltage L6) and erasing up-ramp voltage L3 are applied to scan electrode SC1 through scan electrode SCn. When the electrodes to be applied with the last sustain pulse are scan electrode SC1 through scan electrode SCn, erasing down-ramp voltage L5 (or erasing down-ramp voltage L6) and erasing up-ramp voltage L3 may be applied to sustain electrode SU1 through sustain electrode SUn. However, in the exemplary embodiments, a structure where the electrodes to be applied with the last sustain pulse are sustain electrode SU1 through sustain electrode SUn and erasing down-ramp voltage L5 (or erasing down-ramp voltage L6) and erasing up-ramp voltage L3 are applied to scan electrode SC1 through scan electrode SCn is preferable.

The exemplary embodiments of the present invention can also be applied to a method for driving a panel by so-called two-phase driving. In the two-phase driving, scan electrode SC1 through scan electrode SCn are divided into a first scan electrode group and a second scan electrode group. Further, each address period is divided into the following two address periods: a first address period where a scan pulse is applied to each scan electrode belonging to the first scan electrode group; and a second address period where the scan pulse is applied to each scan electrode belonging to the second scan electrode group. Also in the two-phase driving, application of the exemplary embodiments of the present invention can provide the advantages similar to the above.

The exemplary embodiments of the present invention are also effective in a panel having an electrode structure where a scan electrode is adjacent a scan electrode and sustain electrode is adjacent to a sustain electrode. In this electrode structure, the electrodes are arranged on front plate 21 in the following order: a scan electrode, a scan electrode, a sustain electrode, a sustain electrode, a scan electrode, a scan electrode, or the like.

The specific numerical values in the exemplary embodiments, e.g. the gradients of up-ramp voltage L1, down-ramp voltage L2, down-ramp voltage L4, erasing up-ramp voltage L3, erasing down-ramp voltage L5, and erasing down-ramp voltage L6, are set according to the characteristics of a 50-inch diagonal panel having 1080 display electrode pairs, and merely show examples in the exemplary embodiments. The present invention is not limited to these numerical values. Preferably, numerical values are set optimum for the characteristics of the panel, the specifications of the plasma display device, or the like. For each of these numerical values, variations are allowed within the range where the above advantages can be obtained.

INDUSTRIAL APPLICABILITY

The present invention can properly adjust the wall charge for a stable address operation, even in a high-definition panel. Thus, the present invention can suppress occurrence of an abnormal discharge in the address periods, and thereby enhance the image display quality. Therefore, the present invention is useful as a plasma display device and a method for driving a panel.

REFERENCE SIGNS LIST

1 Plasma display device
10 Panel (Plasma display panel)
21 Front plate
22 Scan electrode
23 Sustain electrode
24 Display electrode pair
25, 33 Dielectric layer
26 Protective layer
31 Rear plate
32 Data electrode
34 Barrier rib
35 Phosphor layer

41 Image signal processing circuit
42 Data electrode driving circuit
43, 143 Scan electrode driving circuit
44 Sustain electrode driving circuit
45 Control signal generating circuit
50 Sustain pulse generating circuit
51, 151 Initializing waveform generating circuit
52, 152 Scan pulse generating circuit
53, 54, 55 Miller integrating circuit
56 Scan IC
61 Constant current generating circuit
Q1, Q2, Q3, Q4, Q5, Q6, Q21, QH1 through QHn, QL1 through QLn,
SW1, SW2 Switching element
C1, C2, C3, C31 Capacitor
D31 Diode
D9, D10 Zener diode
CP1 Comparator
R1, R2, R3, R9, R12, R13 Resistor
Q9 Transistor
L1 Up-ramp voltage
L2, L4 Down-ramp voltage
L3 Erasing up-ramp voltage
L5, L6 Erasing down-ramp voltage

The invention claimed is:

1. A plasma display device comprising:

a plasma display panel, the plasma display panel being driven by a subfield method in which a plurality of subfields is set in one field for gradation display, and each of the subfields has an initializing period, an address period, and a sustain period, the plasma display panel having a plurality of scan electrodes; and a scan electrode driving circuit for generating a first falling down-ramp voltage in the initializing period, generating a sustain pulse in the sustain period, generating a rising up-ramp voltage at an end of the sustain period, and applying the voltages to the scan electrodes, wherein, after generating the sustain pulse in the sustain period, the scan electrode driving circuit generates a second down-ramp voltage that has a portion falling with a gradient gentler than that of the first down-ramp voltage, and after generating the second down-ramp voltage, the scan electrode driving circuit generates the up-ramp voltage, and applies the voltages to the scan electrodes.

2. The plasma display device of claim 1, wherein the scan electrode driving circuit generates the second down-ramp voltage so that the second down-ramp voltage includes a portion falling with a gradient gentler than that of the first down-ramp voltage and a portion falling with a gradient steeper than the gentler gradient, and the scan electrode driving circuit applies the voltage to the scan electrodes.

3. The plasma display device of claim 1, wherein the scan electrode driving circuit generates the second down-ramp voltage with a gradient equal to or steeper than −0.5 V/μsec and gentler than −2.5 V/μsec, and the scan electrode driving circuit applies the voltage to the scan electrodes.

4. A method for driving a plasma display panel, comprising the steps of:

driving the plasma display panel having a plurality of scan electrodes, by a subfield method in which a plurality of subfields is set in one field for gradation display, and each of the subfields has an initializing period, an address period, and a sustain period;

generating a first falling down-ramp voltage in the initializing period, generating a sustain pulse in the sustain period, generating a rising up-ramp voltage at an end of the sustain period, and applying the voltages to the scan electrodes; and after generating the sustain pulse in the sustain period, generating a second down-ramp voltage that has a portion falling with a gradient gentler than that of the first down-ramp voltage and applying the voltage to the scan electrodes, and after generating the second down-ramp voltage, generating the up-ramp voltage and applying the voltage to the scan electrodes.

5. A plasma display device comprising:

a plasma display panel, the plasma display panel being driven by a subfield method in which a plurality of subfields is set in one field for gradation display, and each of the subfields has an initializing period, an address period, and a sustain period, the plasma display panel having a plurality of scan electrodes; and a scan electrode driving circuit for generating a first falling down-ramp voltage in the initializing period, generating a sustain pulse in the sustain period, generating a rising up-ramp voltage at an end of the sustain period, and applying the voltages to the scan electrodes, wherein, after generating the sustain pulse in the sustain period, the scan electrode driving circuit generates a third down-ramp voltage that falls to a voltage lower than a minimum voltage of the first down-ramp voltage, and after generating the third down-ramp voltage, the scan electrode driving circuit generates the up-ramp voltage, and applies the voltages to the scan electrodes.

6. The plasma display device of claim 5, wherein the scan electrode driving circuit generates the third down-ramp voltage so that a minimum voltage of the third down-ramp voltage is lower than the minimum voltage of the first down-ramp voltage and equal to or higher than the minimum voltage of the first down-ramp voltage minus 2 (V), and the scan electrode driving circuit applies the voltage to the scan electrodes.

7. A method for driving a plasma display panel, comprising the steps of:

driving the plasma display panel having a plurality of scan electrodes, by a subfield method in which a plurality of subfields is set in one field for gradation display, and each of the subfields has an initializing period, an address period, and a sustain period;

generating a first falling down-ramp voltage in the initializing period, generating a sustain pulse in the sustain period, generating a rising up-ramp voltage at the end of the sustain period, and applying the voltages to the scan electrodes; and after generating the sustain pulse in the sustain period, generating a third down-ramp voltage that falls to a voltage lower than a minimum voltage of the first down-ramp voltage and applying the voltage to the scan electrodes, and after generating the third down-ramp voltage, generating the up-ramp voltage and applying the voltage to the scan electrodes.

* * * * *